US009493300B2

(12) United States Patent
Eversole et al.

(10) Patent No.: US 9,493,300 B2
(45) Date of Patent: Nov. 15, 2016

(54) EXTERNAL IMPACTOR FOR BULK STORAGE CONTAINERS

(71) Applicant: The GSI Group, LLC, Assumption, IL (US)

(72) Inventors: Brad Eversole, Tower Hill, IL (US); Thomas D. Fleshner, Shelbyville, IL (US); Thomas Stuthman, Taylorville, IL (US)

(73) Assignee: The GSI Group LLC, Assumption, IL (US)

( * ) Notice: Subject to any disclaimer, the term of this patent is extended or adjusted under 35 U.S.C. 154(b) by 629 days.

(21) Appl. No.: 13/644,706

(22) Filed: Oct. 4, 2012

(65) Prior Publication Data

US 2013/0082073 A1 Apr. 4, 2013

Related U.S. Application Data

(60) Provisional application No. 61/543,164, filed on Oct. 4, 2011.

(51) Int. Cl.
*B65D 88/66* (2006.01)
*B25D 11/10* (2006.01)

(52) U.S. Cl.
CPC ..... *B65D 88/66* (2013.01); *B25D 11/106* (2013.01)

(58) Field of Classification Search
CPC ..... B65D 88/64; B65D 88/66; B65D 88/665
USPC ..... 222/196, 196.2, 197, 200, 199, 216, 222/217, 218, 221, 226, 243, 198, 18, 5.1, 222/202, 203; 700/231–244; 366/39, 30; 221/200; 198/533, 525, 550.2; 414/415, 403, 28, 303; 294/68.1, 294/68.21; 105/238.1, 247, 239, 240; 209/381, 328, 338, 330, 336, 334, 347, 209/349; 406/134; 173/17, 32, 90–115, 173/117, 118, 120–122, 124–133, 135–138, 173/202–212; 227/132; 74/53, 55;
(Continued)

(56) References Cited

U.S. PATENT DOCUMENTS 1,491,285 A * 4/1924 Blake ..... B25D 11/10 173/202
1,687,425 A * 10/1928 Briggs ..... F01B 9/023 123/197.4

(Continued)

FOREIGN PATENT DOCUMENTS

JP 2006111352 A 4/2006
JP 2008127047 A 6/2008
JP 2010052784 A 3/2010

OTHER PUBLICATIONS

International Search Report and Written Opinion from corresponding International Application No. PCT/US2012/058591 mailed Mar. 19, 2013.

(Continued)

*Primary Examiner* — Kevin P Shaver
*Assistant Examiner* — Michael J Melaragno

(57) ABSTRACT

An impactor is externally securable to a container of flowable material to break up bridging or clumping of the material in the container. The impactor comprises a strike plate mountable to an outlet hopper or the like and a drive which axially reciprocally moves the hammer, such that operation of the drive causes the hammer to impact the strike plate to thereby pass vibrations into the container.

19 Claims, 29 Drawing Sheets

(58) Field of Classification Search
USPC ..... 248/229.1–229.26, 559, 205.1, 213.1, 248/230.8, 219.4
See application file for complete search history.

(56) References Cited

U.S. PATENT DOCUMENTS 1,712,456 A * 5/1929 Kollock ..... B25D 11/108 173/170
1,898,069 A * 2/1933 Tschudi ..... B25D 11/10 173/100
1,989,415 A * 1/1935 Hartman ..... 414/421
2,229,037 A * 1/1941 Boldman ..... B61D 7/32 193/2 A
2,317,158 A * 4/1943 Westover ..... B25D 11/10 173/203
2,342,601 A * 2/1944 Pyle ..... B25D 11/066 173/203
2,562,642 A * 7/1951 Saxer ..... B21J 7/14 74/55
2,689,102 A * 9/1954 Whalen ..... F16L 41/008 248/230.5
2,739,492 A * 3/1956 Lux ..... B62M 25/00 280/236
2,762,531 A * 9/1956 Haugen ..... 222/620
2,861,548 A * 11/1958 Burgess, Jr. ..... B06B 1/183 91/227
2,955,828 A * 10/1960 Kinsella ..... B65G 69/00 198/642
3,003,733 A * 10/1961 Peterson ..... B65G 27/00 248/223.41
3,177,953 A * 4/1965 Pcterson ..... 173/121
3,199,359 A * 8/1965 Beezer ..... F16H 25/14 74/55
3,216,329 A * 11/1965 Peterson ..... 91/52
3,253,663 A * 5/1966 Burgess, Jr. ..... B06B 1/183 173/131
3,261,508 A * 7/1966 Wahl ..... B65D 88/66 222/161
3,272,397 A * 9/1966 Bean ..... 222/200
3,302,732 A * 2/1967 Roll ..... 173/205
3,358,778 A * 12/1967 Ferwerda ..... B25D 11/10 173/202
3,363,806 A 1/1968 Blakeslee et al.
3,415,396 A * 12/1968 Peterson ..... 414/525.8
3,448,817 A * 6/1969 Shojiro ..... B25D 11/108 173/203
3,587,754 A * 6/1971 Laatsch ..... B21J 15/105 173/107
3,715,059 A * 2/1973 Hyer ..... 222/199
3,731,907 A * 5/1973 Lash ..... B01F 11/0266 366/114
3,741,366 A * 6/1973 Van Melle et al. ..... 198/400
3,828,984 A * 8/1974 Gmuer ..... B65D 88/66 222/196
3,971,493 A * 7/1976 Williams ..... B65D 90/626 141/351
4,070,947 A * 1/1978 Crewse ..... B65D 88/66 91/39
4,076,149 A * 2/1978 Saxinger ..... 222/202
4,078,439 A * 3/1978 Iturriaga-Notario .... F04B 27/02 123/197.1
4,082,151 A * 4/1978 Finney ..... B25D 11/102 173/203
4,082,152 A 4/1978 Whitworth
4,103,747 A * 8/1978 Finney ..... B25D 11/102 173/203
4,105,143 A * 8/1978 Blinn ..... B65G 65/44 222/161
4,111,060 A * 9/1978 Nerini ..... B23Q 5/027 144/35.2
4,285,447 A * 8/1981 Fairbank ..... B65D 88/66 198/533
4,318,446 A * 3/1982 Livesay ..... B25D 11/10 173/13
4,408,889 A * 10/1983 Peschl ..... B01F 5/24 222/199
4,531,598 A * 7/1985 Kitagawa ..... B65B 39/002 177/105
4,545,509 A * 10/1985 Musschoot ..... B65D 88/66 222/181.1
4,630,941 A * 12/1986 Chainer ..... F16C 29/025 310/323.01
4,883,201 A * 11/1989 Poulton ..... B65D 90/205 222/105
4,974,494 A * 12/1990 Kroger ..... 91/433
4,996,907 A * 3/1991 Kroger ..... 91/433
5,215,228 A * 6/1993 Andrews et al. ..... 222/203
5,322,195 A * 6/1994 Ellis ..... B65D 90/205 222/105
5,341,961 A * 8/1994 Hausam ..... 222/217
5,413,254 A * 5/1995 Decker ..... B65G 65/44 222/199
5,448,974 A * 9/1995 Toda ..... F02D 9/02 123/400
5,533,650 A * 7/1996 Conrad ..... B65D 88/66 222/161
5,601,149 A * 2/1997 Kawasaki ..... B25B 21/02 173/109
5,769,281 A * 6/1998 Bates ..... B65D 88/64 222/196
5,794,325 A * 8/1998 Fallandy ..... B25D 11/108 173/203
5,799,918 A * 9/1998 Swinderman ..... B65D 88/66 248/219.1
5,833,205 A * 11/1998 Lindbeck ..... B65D 88/66 221/200
5,871,277 A * 2/1999 Lash ..... B65D 88/66 366/124
5,960,990 A * 10/1999 Radosevich ..... B65D 88/66 222/1
6,015,225 A 1/2000 Williams
6,058,588 A * 5/2000 Wadensten ..... B25B 27/14 29/256
6,062,826 A * 5/2000 Morimoto ..... F16K 31/52408 137/624.13
6,257,352 B1 * 7/2001 Nelson ..... B28D 1/26 173/211
6,257,543 B1 * 7/2001 Huelsmann ..... B06B 1/00 248/638
6,347,540 B1 * 2/2002 De Biasi ..... B21D 43/055 198/621.3
6,733,414 B2 * 5/2004 Elger ..... B25F 5/001 173/109
6,755,114 B2 * 6/2004 Onoe ..... 91/275
6,763,897 B2 * 7/2004 Hanke ..... B25D 17/24 173/162.2
6,785,950 B1 * 9/2004 Scirbona ..... B25D 11/102 173/203
6,966,687 B1 11/2005 Elefsrud
7,032,687 B2 * 4/2006 Rask ..... B44B 3/005 173/203
7,195,217 B1 * 3/2007 Wadensten ..... B61D 7/32 248/223.41
7,312,408 B2 * 12/2007 Kawanishi ..... G01G 17/06 177/105
7,358,451 B2 * 4/2008 MacMichael et al. ..... 177/108
7,416,031 B2 * 8/2008 Murakami ..... B25B 21/026 173/109
7,458,547 B1 * 12/2008 Wadensten ..... B65D 88/66 248/222.14
7,475,793 B2 * 1/2009 Wahl ..... 222/77
7,503,305 B2 * 3/2009 Johnson ..... F01B 9/026 123/197.4
7,712,634 B2 * 5/2010 MacMichael ..... B65B 1/08 222/1
8,196,674 B2 * 6/2012 Ikuta ..... B25D 17/24 173/162.1

(56) References Cited

U.S. PATENT DOCUMENTS

| | | | | |
|---|---|---|---|---|
| 8,413,742 | B2 * | 4/2013 | Ikuta | B25D 17/08 173/122 |
| 2003/0025018 | A1 * | 2/2003 | Mashburn | B02C 17/10 241/175 |
| 2006/0127228 | A1 * | 6/2006 | Rohring | F04B 1/0413 417/215 |
| 2006/0283274 | A1 * | 12/2006 | Hsu | F16H 21/18 74/55 |
| 2010/0005934 | A1 * | 1/2010 | Guilbault | B25G 1/04 81/177.2 |
| 2010/0009023 | A1 * | 1/2010 | Wolk | B29C 51/22 425/112 |
| 2011/0083399 | A1 * | 4/2011 | Lettkeman | E04H 12/24 52/745.21 |
| 2011/0114662 | A1 | 5/2011 | Saunders et al. | |
| 2011/0240671 | A1 * | 10/2011 | McDiarmid | G05D 19/02 222/1 |
| 2012/0180605 | A1 * | 7/2012 | Ahrens | B25B 23/0021 81/177.2 |
| 2012/0193357 | A1 * | 8/2012 | Pleima | A01F 25/2018 220/200 |
| 2014/0116837 | A1 * | 5/2014 | Marchesini | B65D 88/66 193/2 B |
| 2014/0137675 | A1 * | 5/2014 | Suzuki | F01L 13/00 74/55 |

OTHER PUBLICATIONS

European Patent Office Search Report of corresponding EPO Application No. 12838810.5 mailed Apr. 17, 2015.

* cited by examiner

EXTERNAL IMPACTOR FOR BULK STORAGE CONTAINERS

CROSS-REFERENCE TO RELATED APPLICATIONS

This application claims priority to U.S. Provisional Application No. 61/543,164, filed Oct. 4, 2011, which is herein incorporated by reference in its entirety.

STATEMENT REGARDING FEDERALLY SPONSORED RESEARCH OR DEVELOPMENT

Not Applicable.

BACKGROUND

This disclosure relates to generally to bulk storage containers, such as grain bins and grain hoppers, which hold flowable material (such as grain or the like), and, in particular, to an external device for reducing the occurrence of bridging of material at the outlet of the bulk storage container.

Bulk storage containers typically have a lower outlet through which the grain (or other flowable material) contained in the bin/hopper exits the storage container. As is known, the material within the storage device can "bridge" (e.g., form a void in the material) at exit of the storage device. This bridging can interfere with the flow of material from the bulk storage container. Various devices have been employed to break up or prevent the formation of such bridges. Some devices reside within and are supported by the container itself. Other devices are predominantly external but require some amount of modification and internal access/disturbance in order to mount. Because such devices have internal components they cannot easily be incorporated in or added to the bulk storage container at a later date. Further, because the device is at least partially internal, repair or replacement of the device can be difficult, and, at a minimum, would require emptying of the bulk storage container of its contents and decommissioning the bulk storage container during the repair. Typical devices include, for example, pneumatic pistons, non-powered and powered internal agitators, and eccentric rotary vibrators. Such devices have additional disadvantages. Pneumatic pistons require a compressed air source and pneumatic control system which may not be readily available and which require additional maintenance. Non-powered agitators do not react to bridging. Through their limited motion, they hope to prevent bridging from occurring. Powered internal agitators attempt to impart additional energy to prevent bridging, but place the source of agitation in a compromising position. Rotary vibrators typically operate at a high frequency and/or load in order to generate sufficient energy to affect the bridging. Unfortunately, due to resonance the very frequency and energy transferred to break up bridges may be detrimental and even destructive to the container itself.

It is further necessary that for whatever device is employed to eliminate such bridging that it not physically damage the bin or the discharge structure attached to the container.

BRIEF SUMMARY OF THE DISCLOSURE

Briefly stated, disclosed is an external device that is secured to the bulk storage container during or after construction of the bulk storage container. The device has no part which extends internally into the bulk storage container, and thus can be removed from the bulk storage container or repaired without significantly impacting the operation of the bulk storage container.

As described below, the device, termed an impactor, includes a hammer which delivers radial energy to the bulk storage container at the level of the container where bridges most commonly occur—at the level of the outlet of the container. Because the impactor is external, it can be added to the bulk storage container after assembly of the bulk storage container, and, in fact, could be moved between bulk storage containers, if desired. Further, because the impactor is external, it can be repaired or replaced without the need to empty bulk storage container and take the bulk storage container off-line. Further, the impactor delivers a controlled amount of energy at a low frequency. Lastly, as long as the drive is not a pneumatic drive, the device will not require an additional air supply or the associated maintenance.

An impactor is disclosed that is externally securable to a container, such as a grain bin or the like, having a quantity of flowable material therein to break up bridging or clumping of the material within the container so that the material may be discharged from the container. The impactor comprises a hammer, a strike plate, and a drive that moves the hammer such that upon operation of the drive the hammer imparts repeated impact loads to the strike plate to thereby transmit impact vibrations to the container to break up the bridging material.

Further, apparatus of the present disclosure is described that at least in part breaks up a void within or bridging of a flowable material in a hopper outlet of a bulk container, the hopper outlet discharging the flowable material into a conveyor system for conveying the discharged material from the container. The apparatus comprises a bracket configured to be removably attached to the exterior of the container and of the hopper outlet proximate the intersection of the container and the hopper outlet with the bracket engaging the intersection. The bracket has a strap attached to the bracket that extends around the intersection so as to hold the bracket in engagement with the intersection. The apparatus further includes a hammer, a strike plate impacted by the hammer with the strike plate being in impact transmission relation with the bracket, and a drive for moving the hammer between a first position in which the hammer is in engagement with the strike plate and a second position in which the hammer is spaced from the strike plate. A spring biases the hammer toward the strike plate, and the drive is operable to release the hammer from the second position so that the hammer moves under the bias of the spring so as to impact the strike plate thereby to transmit impact energy to the container, which tends to break up the bridging of the material.

A method for breaking up bridging or clumping of a flowable material in a container is disclosed where the container has an outlet hopper. The method comprises reciprocally driving a hammer which is externally mounted to the outlet hopper such that the hammer repeatedly delivers impact energy to the outlet hopper.

Other objects and features of the impactor will be in part apparent to those of ordinary skill in the art.

BRIEF DESCRIPTION OF THE SEVERAL VIEWS OF THE DRAWINGS

Corresponding reference numerals will be used throughout the several figures of the drawings.

DESCRIPTION OF PREFERRED EMBODIMENTS

The following detailed description illustrates the apparatus and methods of the present disclosure by way of example and not by way of claimed limitation. This description will clearly enable one skilled in the art to make and use the claimed invention, and describes several embodiments, adaptations, variations, alternatives and uses of the disclosed apparatus and methods, including what we presently believe is the best mode for carrying out the disclosed embodiments. Additionally, it is to be understood that the apparatus and methods herein disclosed are not limited in preferred embodiments disclosed herein. The claimed invention is capable of other embodiments and of being practiced or being carried out in various ways, as would be readily apparent to one of ordinary skill in the art. Also, it is to be understood that the phraseology and terminology used herein is for the purpose of description and should not be regarded as limiting.

Figure 1:
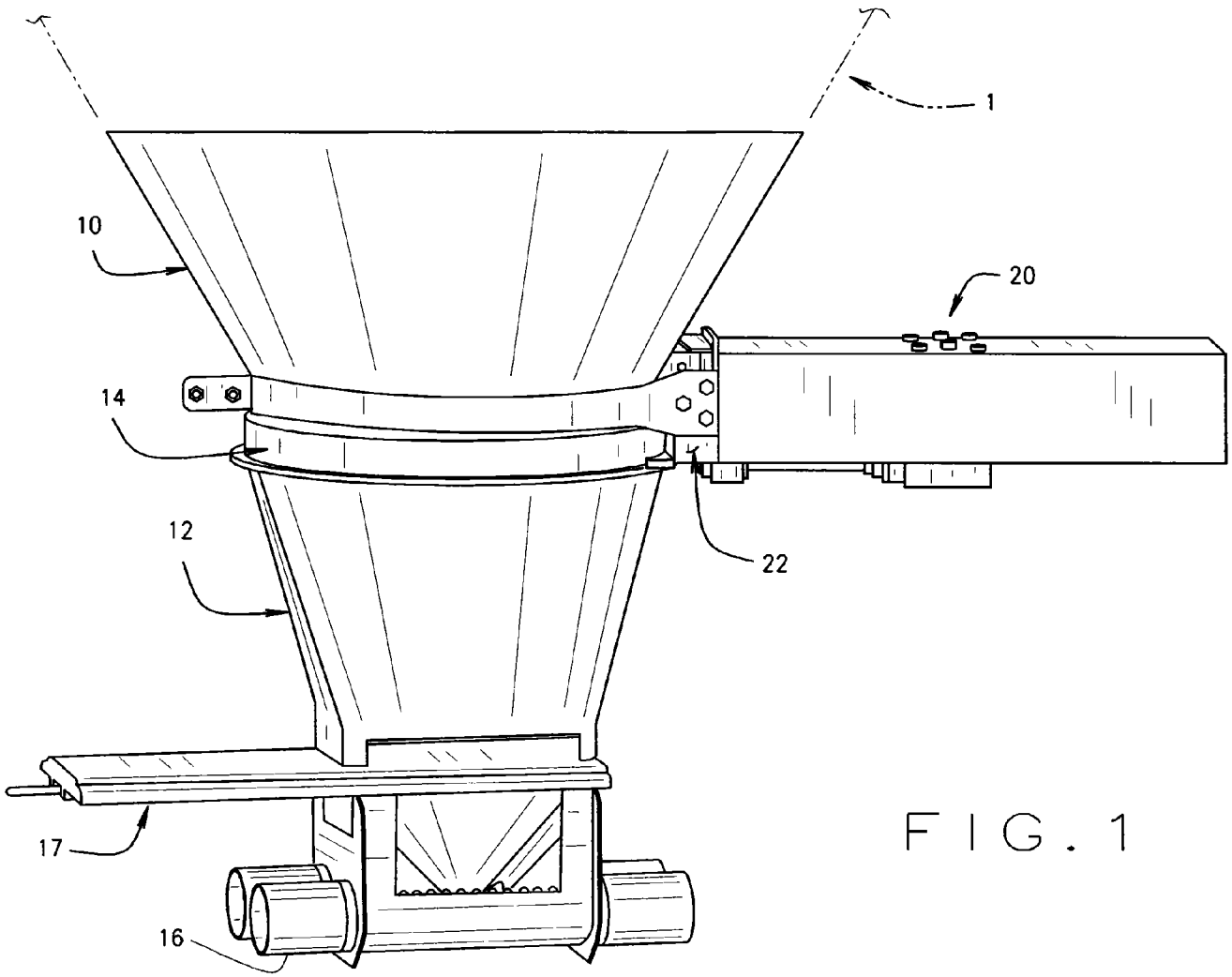
FIG. 1 is a perspective view of an outlet hopper of a bulk storage container with an illustrative embodiment of an external impactor secured thereto.
Figure 2:
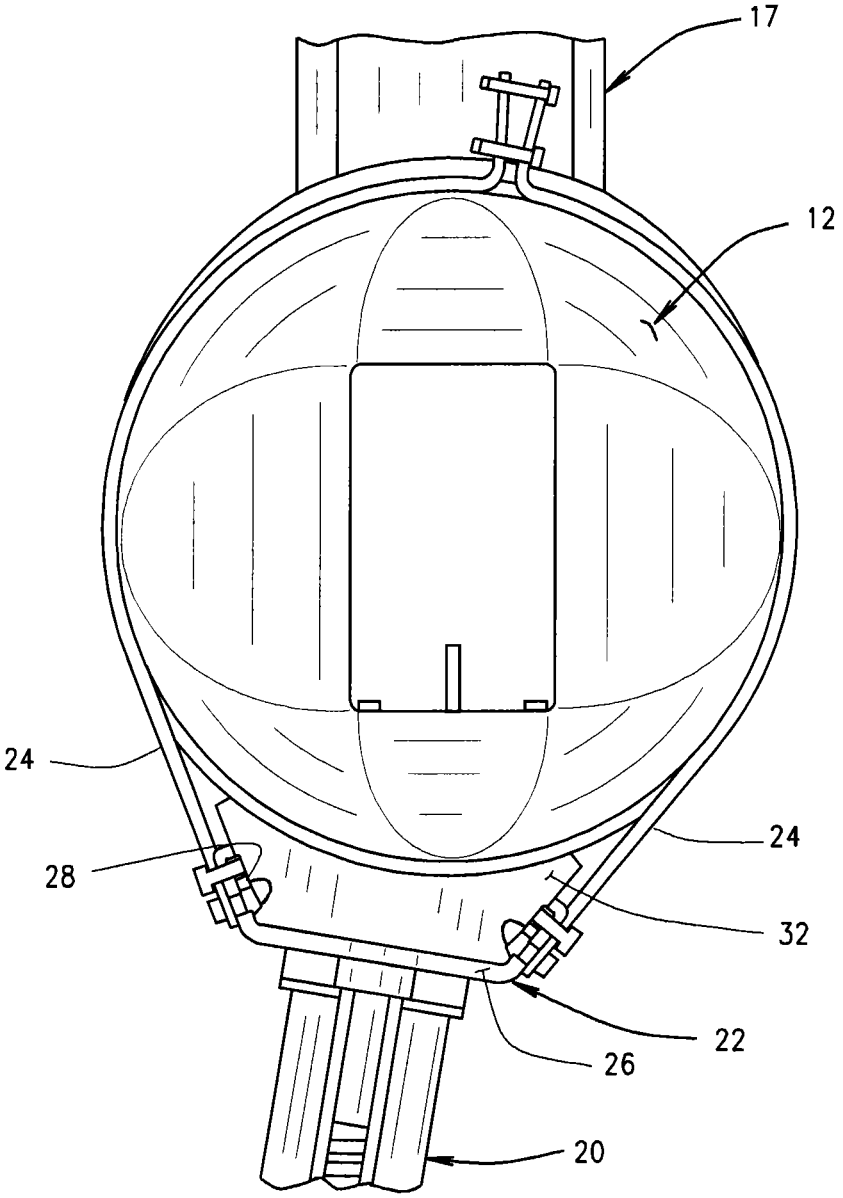
FIG. 2 is a horizontal cross-section taken along line 2-2 of FIG. 1 showing the removable mounting of the impactor to an outlet hopper and collar of a bulk storage container.
Figure 3:
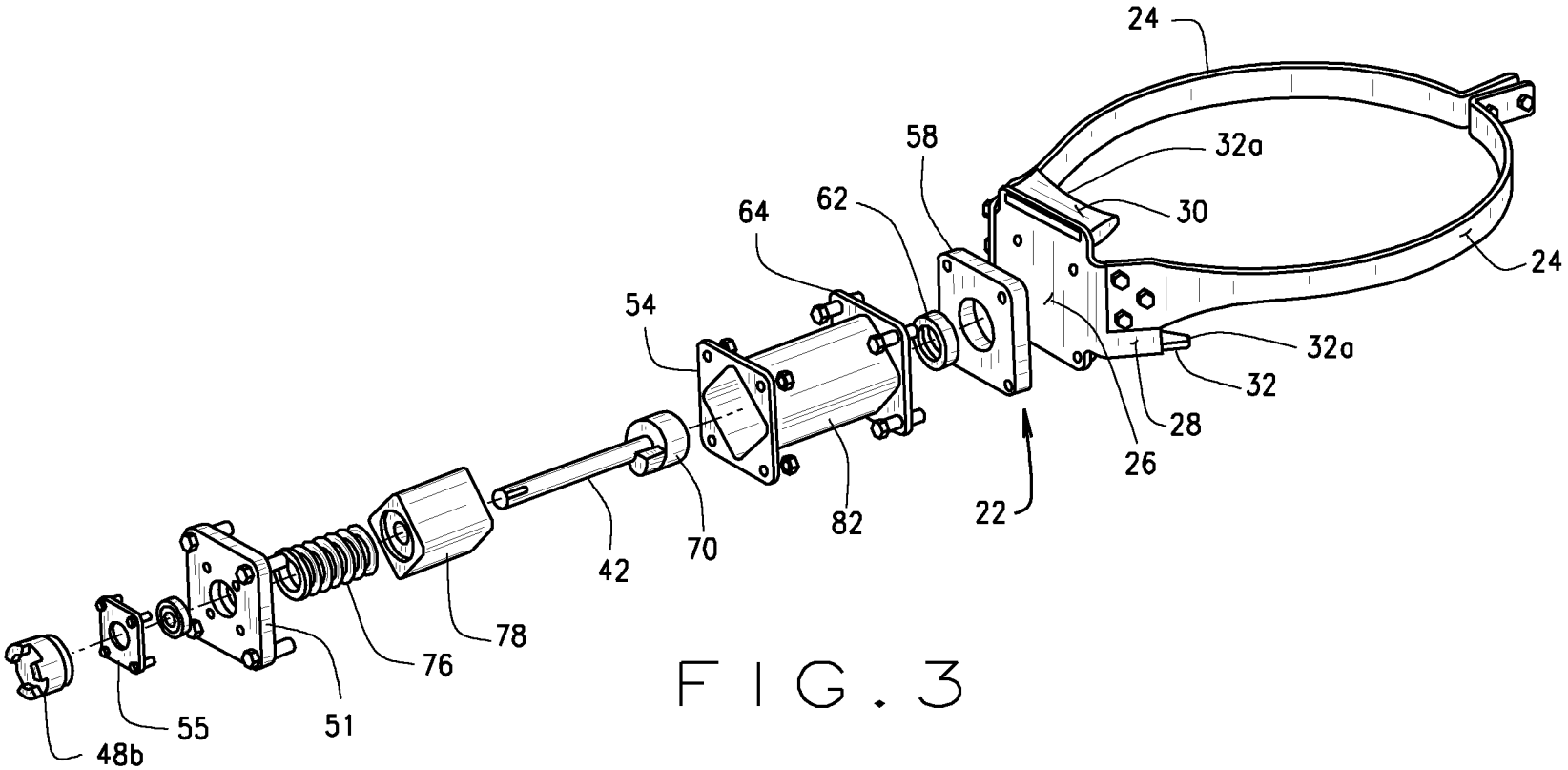
FIG. 3 is an exploded perspective view of the impactor, and the mounting system for mounting the impactor to a storage bin.

A bulk storage container, such as a bulk feed tank or a hopper bottom bin, a portion of which is illustrated in phantom in FIG. 1 and which is indicated in its entirety at 1. Typically, the container has a funnel shaped outlet 10 at the bottom of the container. An exit or transfer member (sometimes referred to as a boot) 12 is connected to the lower end of hopper outlet 10 by means of a collar 14. As is known, the transfer member 12 transitions between a round circumference at its top and a quadrilateral circumference at its bottom, and can be used to place the hopper in communication with delivery or conveyor tubes 16. The delivery tubes 16 will convey the flowable material from the hopper to another desired destination. A slide gate valve 17 is provided to close the flow of the material from the transfer member 12 to the conveyor tubes 16. For example, if the hopper contains feed, the feed can be delivered to an animal facility (such as a poultry or swine house) to feed the animals contained therein by way of the conveyor tubes. Or, if the hopper contains grain, the grain can be delivered to transporters (trucks, barges, etc.) or be transferred from a dryer to a storage bin, etc. Within the context of this disclosure, it will be understood that the bulk storage container 1 includes hopper outlet 10 and transfer member 12.

When bridges or voids form in the flowable material within the storage container, particularly during unloading, such bridges or voids often form in the hopper outlet 10 or at the junction of the hopper outlet 10 and the transfer member 12. They may also form at the outlet of the transfer member. When such bridges or voids form, they interfere with the flow of the material from the storage container and must be broken up. A first illustrative embodiment of an impactor 20 is shown in the FIGS. 1-15B. This impactor can deliver radially directed, repeated impact to the hopper outlet and collar area to break up such bridges.

It is noted that although the impactor 20 is described for use in conjunction with a bulk storage container, the impactor can be used with other fluid material processing equipment, such as grain dryers, transportation equipment (such as hopper rail cars and trailers), etc.

As shown in FIGS. 1-13, the impactor 20 is mounted to the bulk storage container around the collar 14 by means of a bracket 22 and mounting straps 24. The bracket 22 includes a front plate 26 (see FIG. 2), which is generally vertical when in position on the bulk storage container. A pair of horizontal wings 28 (see FIG. 3) extends obliquely from the sides of the plate 26, and an upper leg 30 and lower leg 32 extend from a back surface of the plate 26, near the top and bottom of the plate, respectively. As shown in FIG. 1, the lower leg 32 engages the collar 14 near the bottom of the collar. The lower leg 32 is generally planar (and generally horizontal) and, to enable the lower leg to engage the collar, and (as shown in FIG. 5) has an inner edge 32*a* shaped correspondingly to the shape of the collar. The inner edge 32*a* is curved or arcuate and matches the curvature of the collar 14 near the bottom of the collar. This curvature of the inner edge 32*a* allows for the lower leg 32 to engage the collar 14 substantially along the full length of the inner edge 32*a* of the lower leg. The upper leg 30 has a first section 30*a* that is generally normal to the plate 26, and a second section 30*b* that extends diagonally upwardly from the end of the first section 30*a*. The upper leg 30*a* has a curved inner edge 30*c* that engages the hopper outlet 10 at about the level of the top edge of the collar 14.

Figure 4:
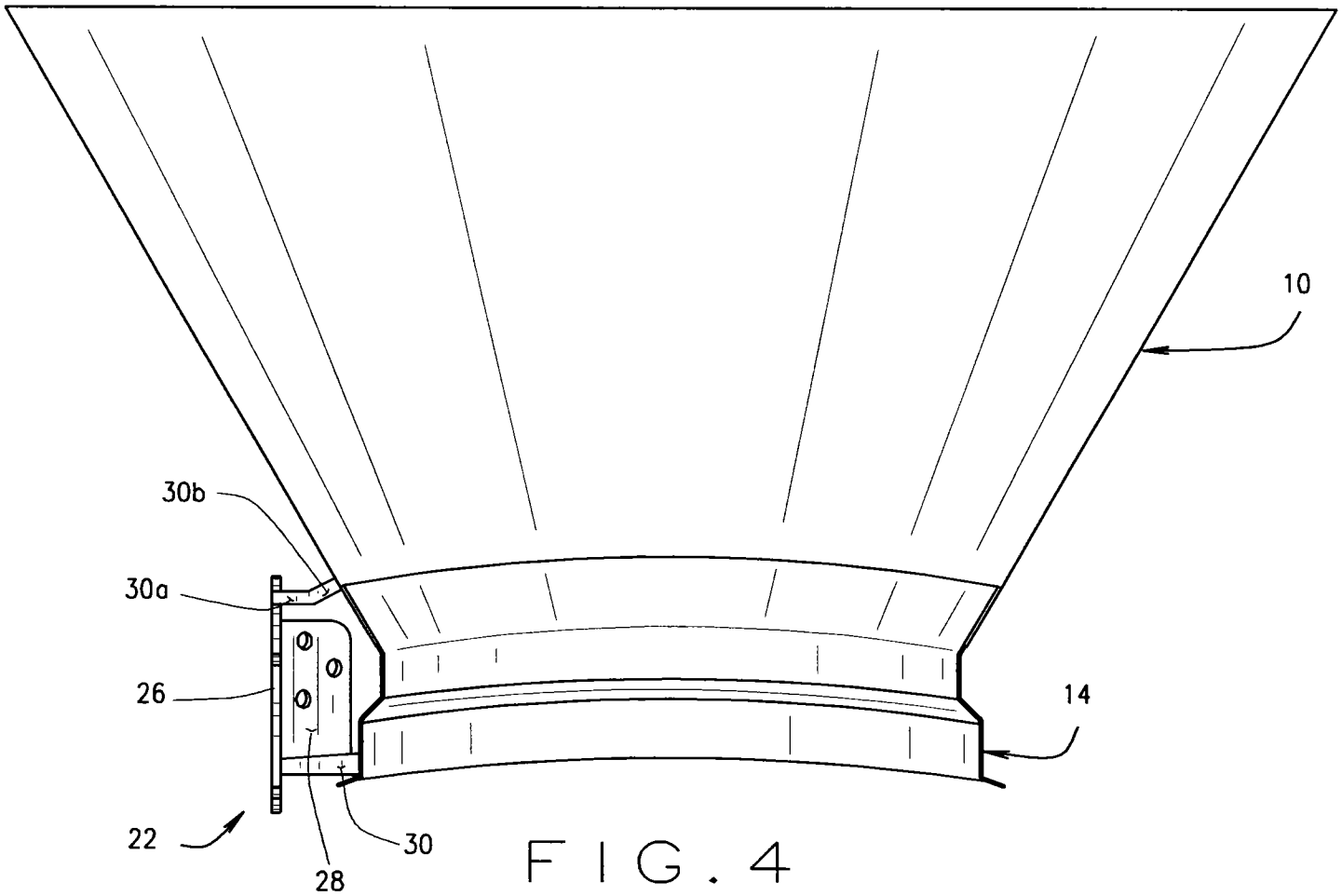
FIG. 4 is a vertical cross-section showing the mounting of the impactor to an outlet hopper and collar of a bulk storage container.
Figure 5:
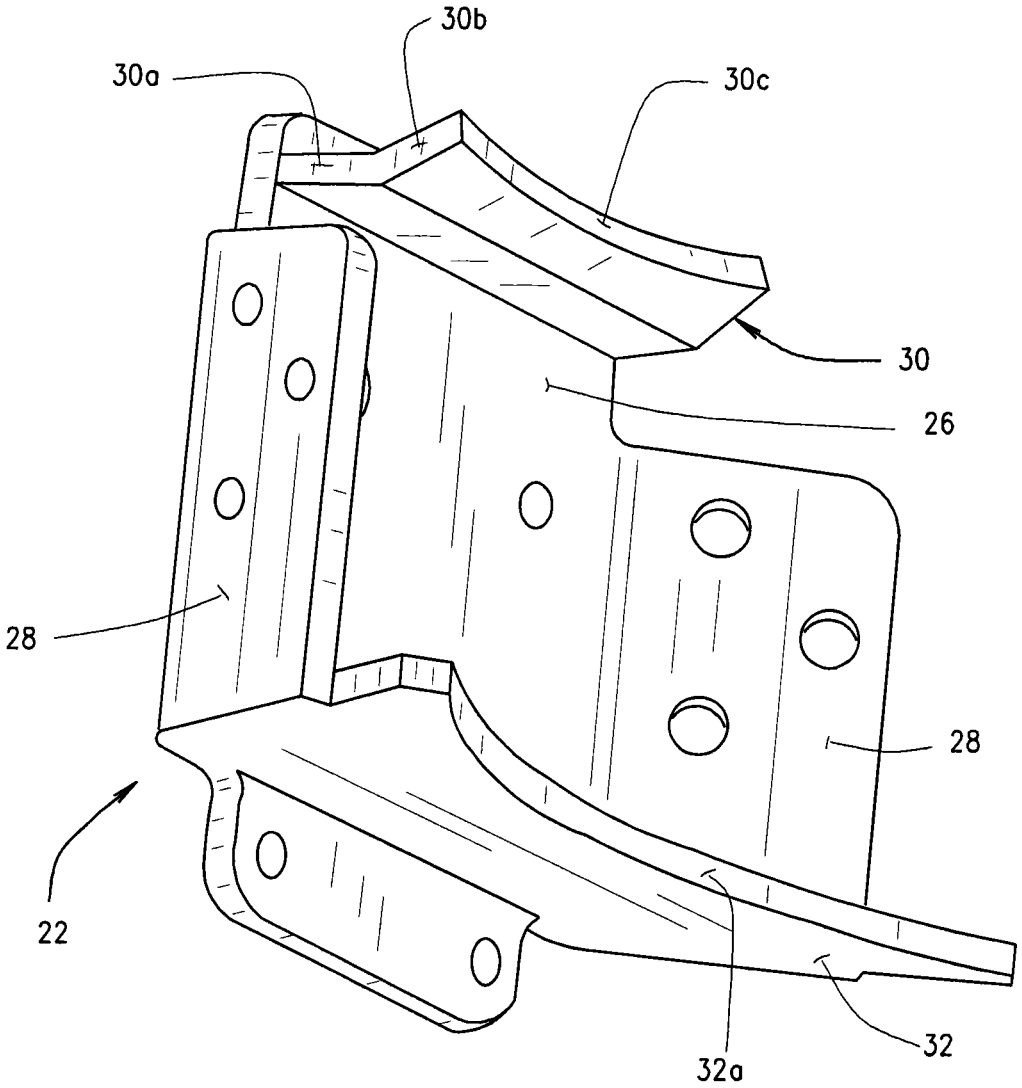
FIG. 5 is a rear perspective view of a bracket used to mount the impactor to the bulk storage container.

As best seen in FIG. 4, an upper portion of the collar 14 is positioned within the hopper outlet 10, and hence, the bracket upper leg 30 engages the outlet hopper 10, rather than the collar 14. This could, of course, be reversed, if desired. That is, the collar 14 could be external to, and surround the bottom of the outlet hopper 10, such that the bracket upper leg 30 engages the collar 14 near the top thereof. As with the bracket lower leg 32, the inner edge 30*c* of the bracket upper leg is shaped correspondingly to the shape of the outlet hopper, such that the inner edge 30*c* will securely or solidly engage or contact the hopper outlet substantially along the full length of the inner edge 30*c*.

To secure the bracket 22 to the bulk storage container, the mounting straps 24 are connected (as with bolts, for example) to the wings 28 of the bracket 22. Two straps 24 are shown in the drawings to extend around the collar 14 to have their distal ends secured together, for example, with bolts. Alternatively, a single strap 24 could extend around the collar, from one wing 28 of the bracket 22 to the other wing of the bracket. The strap 24 is sized such that the bracket 22 will be held tightly and securely against bulk storage container and/or against collar 14. If desired, the strap 24 can be provided with a tightening mechanism to ensure a tight and secure fit of the bracket 22 to the bulk storage container, so that the legs 30,32 are in intimate contact with the outlet hopper and collar of the bulk storage container. As will become apparent below, the contact between the legs 30, 32 of the bracket 22 and the bulk storage container must be sufficient to effectively pass or transmit vibrational energy imparted to the bracket 22 through to the bulk storage container. To facilitate the transmission of vibrational impact energy from impactor 20 to the container, the bracket 22 and the strap(s) 24 are preferably made of metal, or other material that will not significantly dampen the vibrations imparted by the impactor 20. It will be appreciated that by attaching the impactor 20 to the container, and more particularly to the hopper 10 and outlet 12 by means of bracket 22 and straps 24, the impactor is secured to the exterior of container 1 in such manner that it may be readily installed or removed and in such manner that no modifications of the container, the hopper 10 or the outlet 12 are required. It will be apparent to those skilled in the art that other configurations may be employed to removably secure the impactor to the container. It will be appreciated that in this manner, the impactor 20 may be retrofitted to existing containers 1.

The components of the impactor 20 are contained within an outer housing 36. The outer housing comprises a top wall 36*a*, front and back walls 36*b*, and an end wall 36*c* remote from the bracket 22. As shown, the outer housing 36 does not include a bottom wall. However, a bottom wall could be included if desired.

Figure 6:
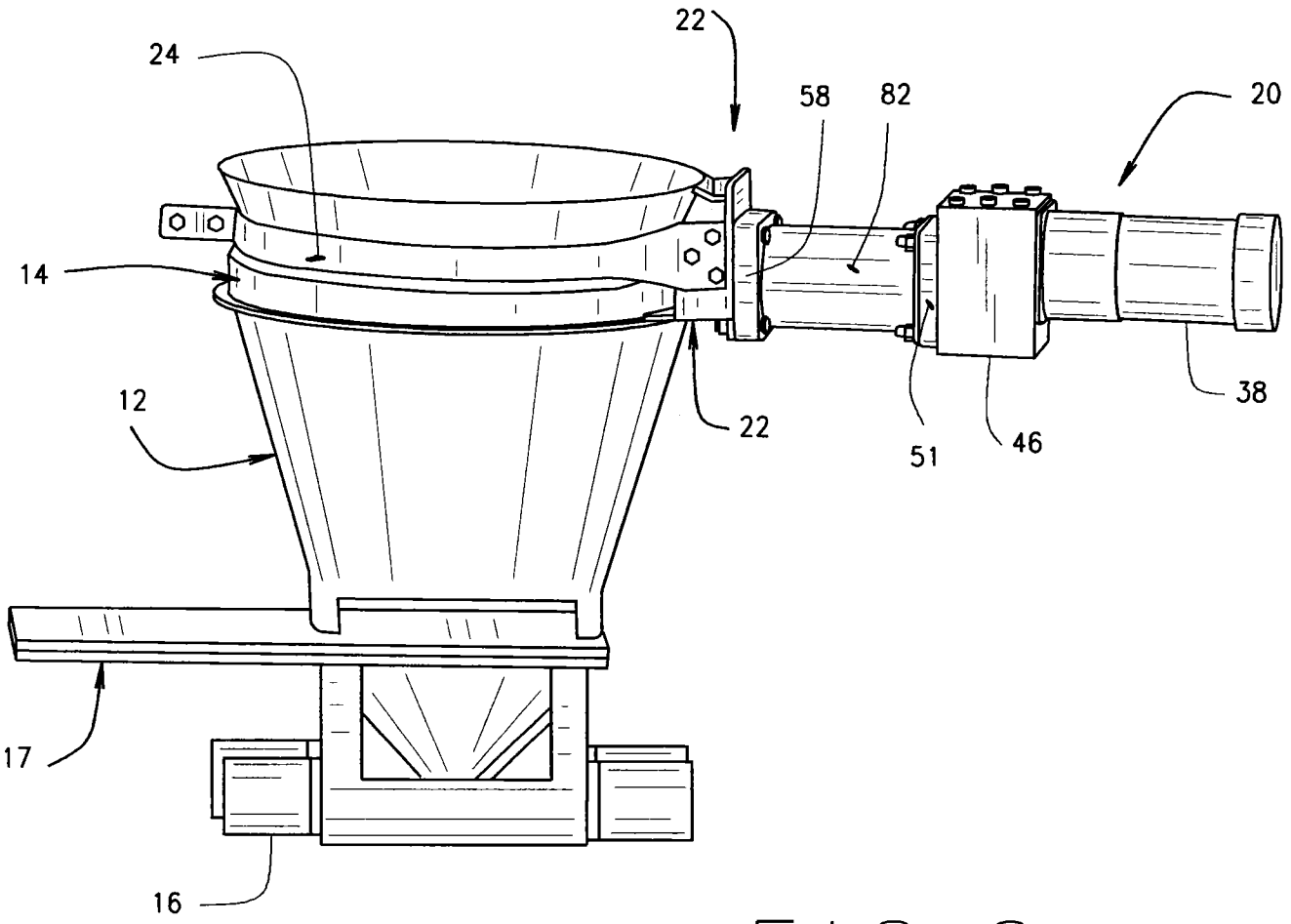
FIG. 6 is a perspective view similar to the view of FIG. 1, but with the hopper removed for clarity and with an outer housing or casing removed from the impactor.
Figure 7:
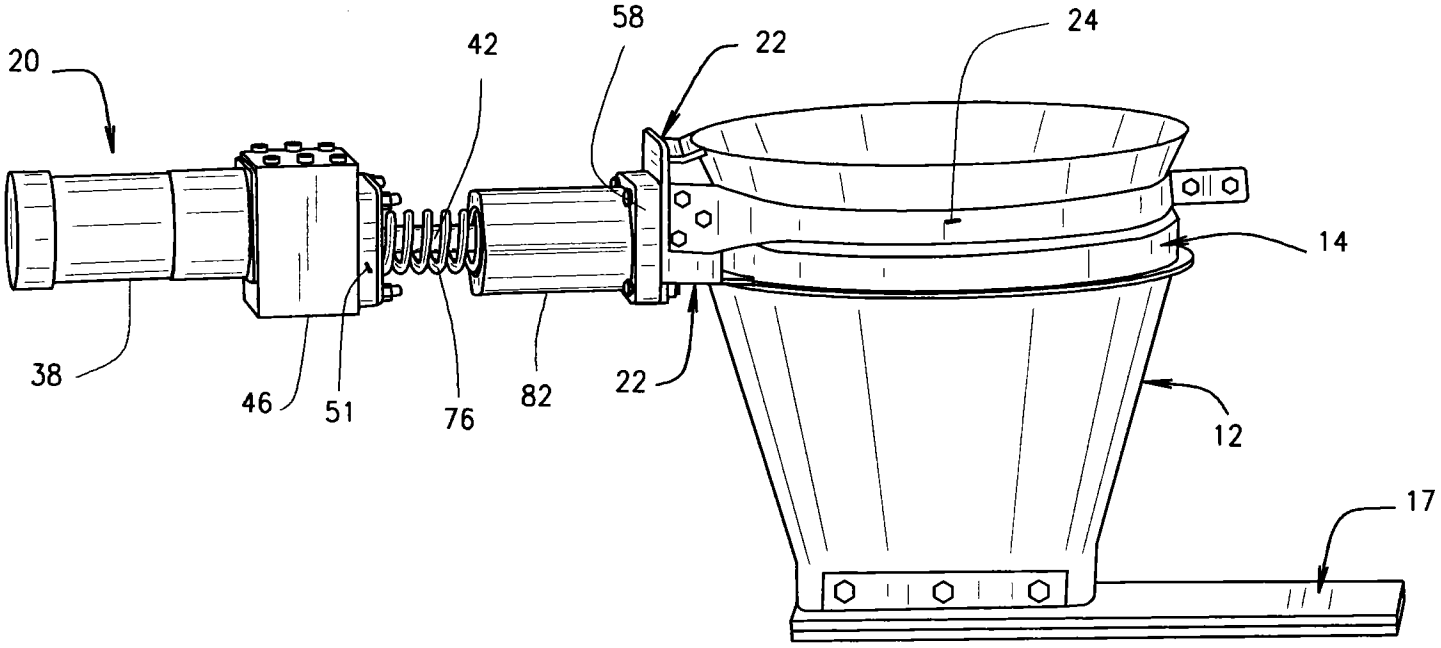
FIG. 7 is a perspective view similar to the view of FIG. 6, but with a guide sleeve removed from the impactor, showing a hammer and spring of the impactor.
Figure 8:
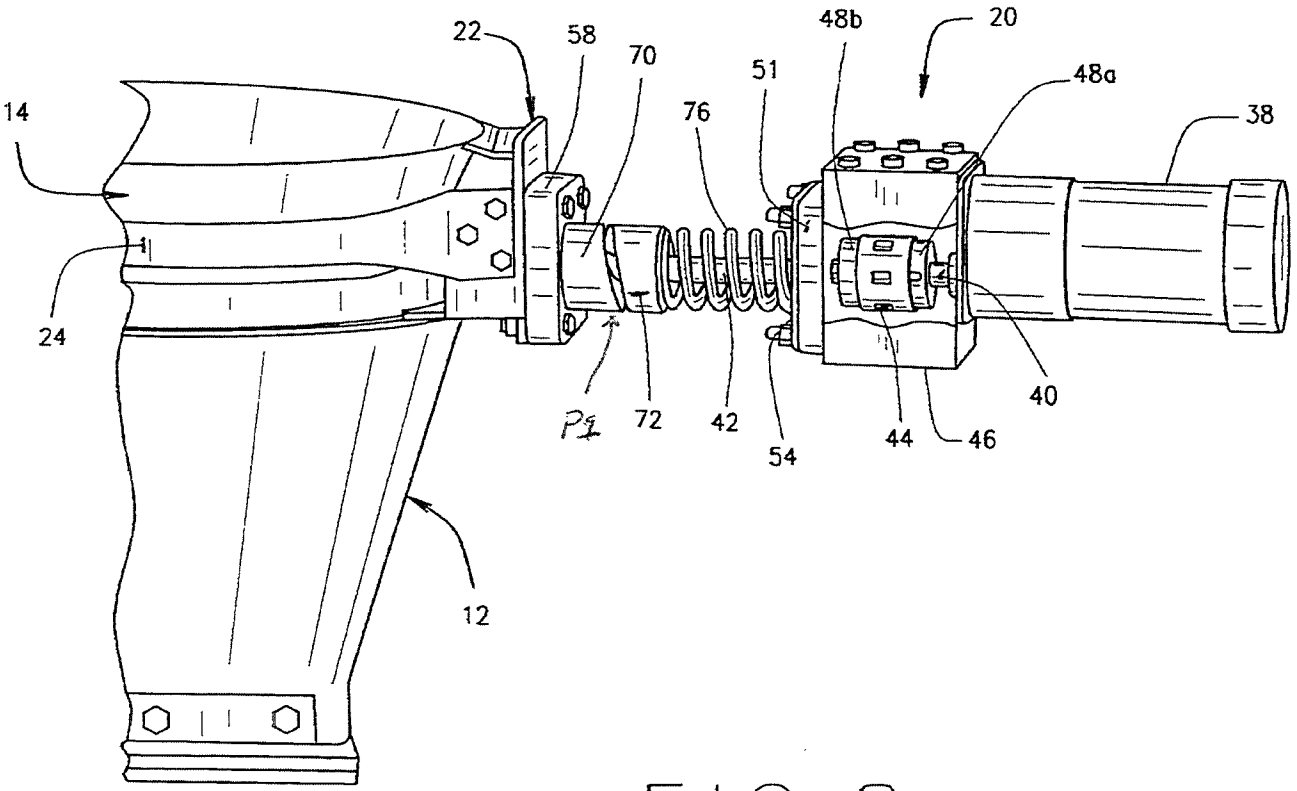
FIG. 8 is a perspective view similar to the view of FIG. 7, but with the hammer removed to show co-operating cams of the impactor and with a wall of a coupling housing removed so that a coupling is visible.
Figure 9:
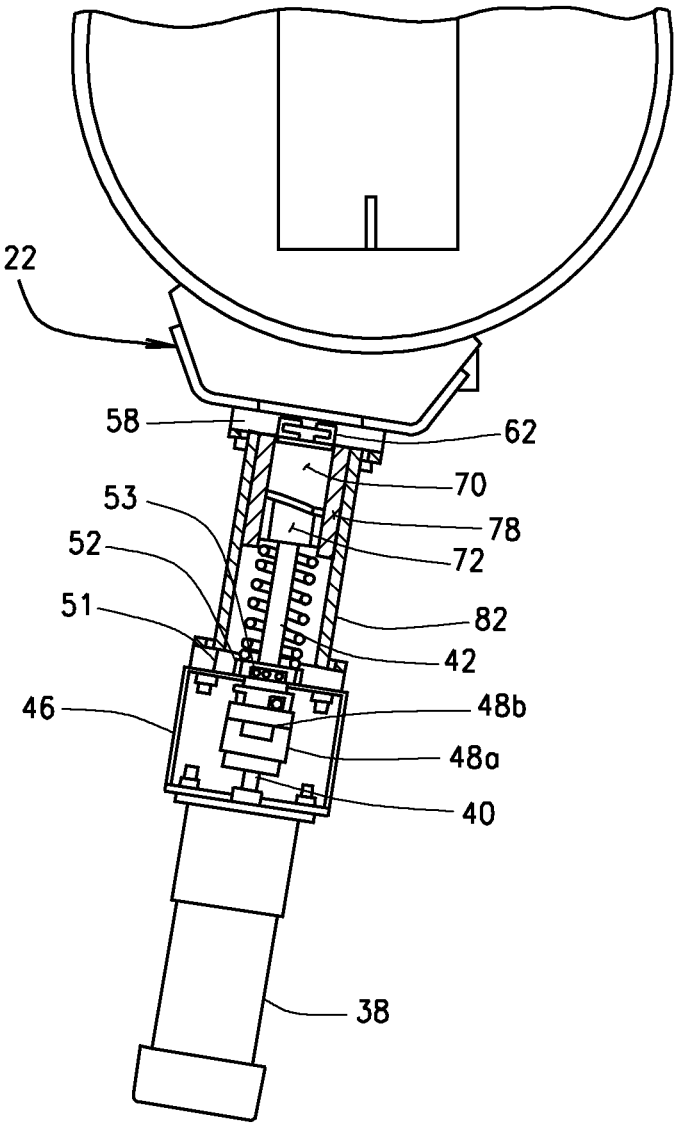
FIG. 9 is a horizontal cross-sectional view taken along line 9-9 of FIG. 8.
Figure 10:
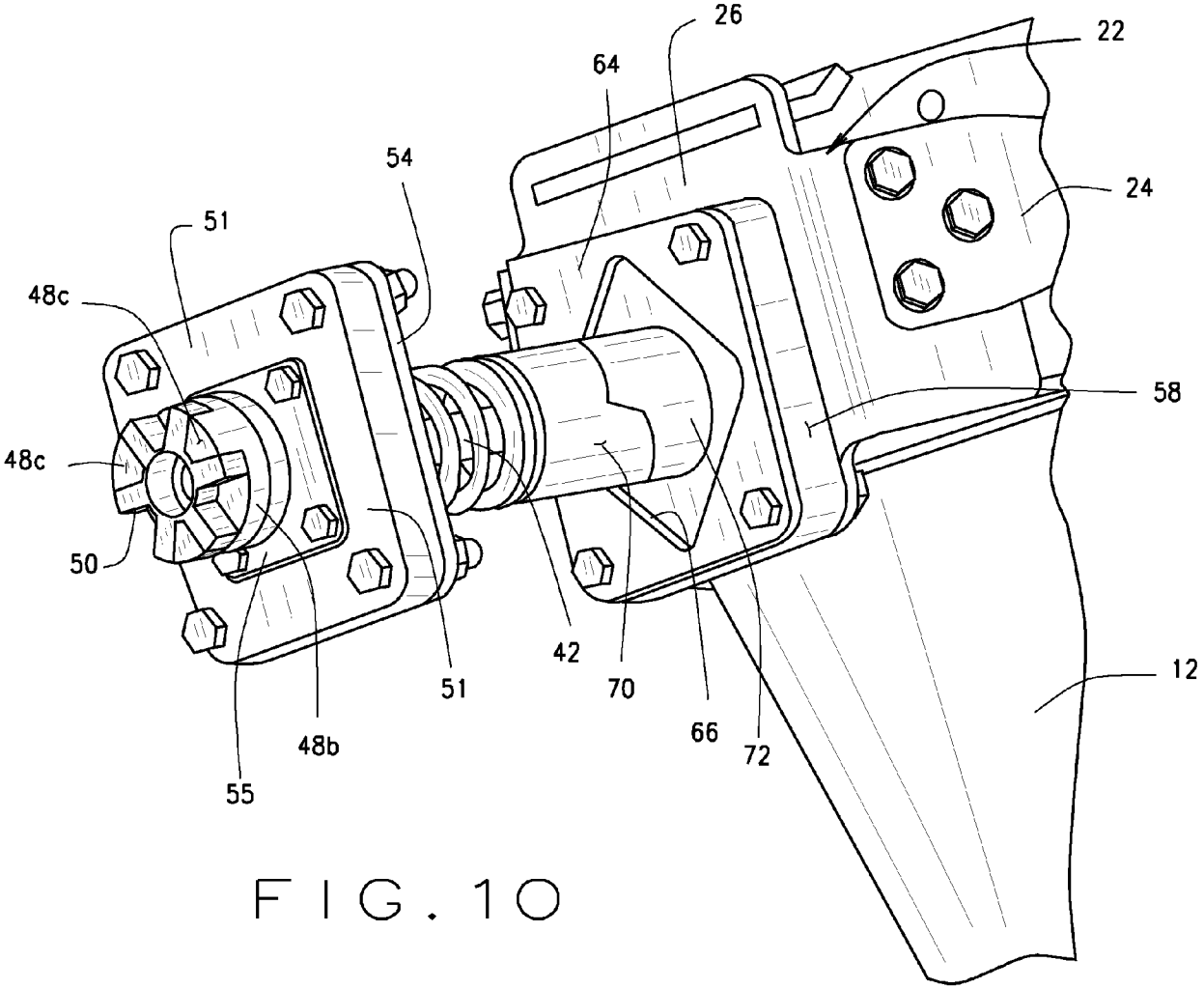
FIGS. 10 and 11 are perspective views in opposite directions, showing plates at opposite ends of the guide sleeve.

Referring now to FIGS. 6-13, impactor 20 is shown to comprise an electric motor 38 (FIG. 6), which rotationally drives an output shaft 40 (See FIG. 8). The output shaft 40 is connected to a driven shaft 42 by means of a coupler 44 contained within a coupler housing 46. As seen in FIG. 6, the coupler housing 46 is secured to the end of motor 38. Turning to FIGS. 8-10, the coupler 44 is shown to comprise opposed halves 48*a*, 48*b*, with coupler half 48*a* being rotationally and axially fixed to the motor output shaft 40 and the other coupler half 48*b* being rotationally fixed to the driven shaft 42. The shafts 40 and 42 can include keys or other projections (not shown) that are received in an internal groove in the coupler halves 48*a*, 48*b*. Alternatively, the coupler halves can be provided with projections that are received in grooves in the shafts 40 and 42. Each of the coupler halves comprises an outer portion 48*a* and an inner portion 48*b*. The inner portion 48*b* includes three axially extending protrusions 48*c* spaced about the inner portion 48*b*. As shown in FIG. 10, a gear-like member 50 having six arms is received on the inner portion 48*b* and held in place by the protrusions 48*c*. As can be appreciated, protrusions 48*c* of one coupling half 48 are offset from the protrusions 48*c* of the other coupling half; and three pair of the arms of the gear-like member surround the protrusions of one coupler half, and the other three pair of arms of the gear-like member surround the protrusions of the other coupler half. Thus, the motor 38 will rotationally drive the coupler half 48*a* which is fixed to the motor output shaft 40; the interference fit of the two coupler halves will then cause the second coupler half 48*b* to rotate, thereby rotating the driven shaft 42. The coupling described and shown is commonly referred to as a jaw coupler. This coupler allows some mis-alignment of shafts 40 and 42. Any other type of coupler can be used which would drivingly connect the driven shaft 42 to the motor output shaft 40.

Figure 11:
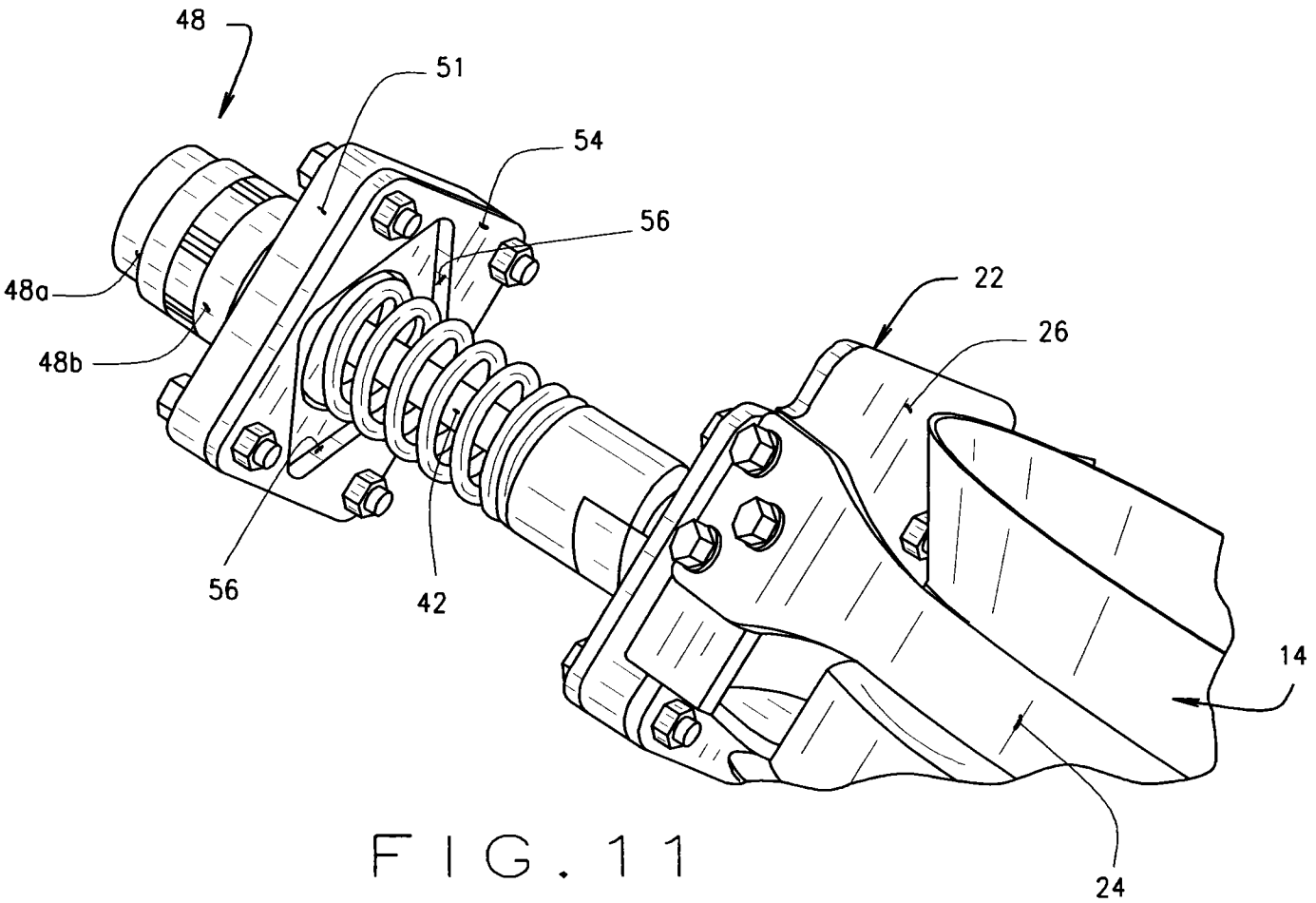
Figure 12:
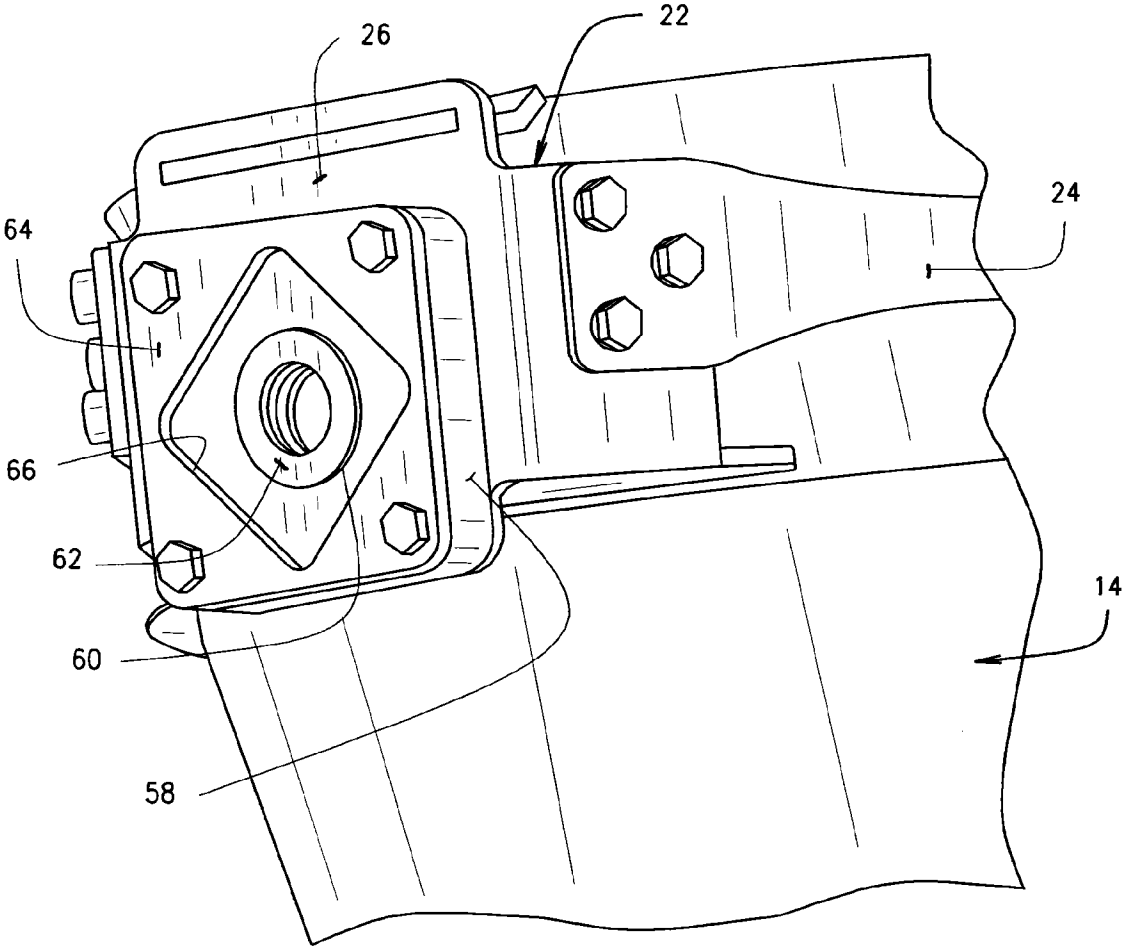
FIG. 12 is a perspective view of the plate secured to the bracket.

An end plate 51 is mounted to the forward end of the coupler housing 46. A hole is provided in the end plate 51 through which the driven shaft 42 extends. A counterbore 52, as shown in FIG. 9, is formed in the backside of the end plate 51. A bearing 53 (see FIG. 9) is mounted in the counterbore 52. A plate 55 is mounted to end plate 51 to retain the bearing. A counterbore 52 is formed in the forward side of the end plate (opposite the coupler housing 46). A second plate 54 (as shown in FIG. 10) is mounted to the forward surface of the end plate 51. As shown in FIG. 11, this second plate 54 has a quadrilateral shaped opening 56 formed therein. A second end plate 58 is mounted on the outer face of plate 26 of the bracket 22. As shown in FIG. 12, like the end plate 50, the plate 58 includes a counter bore 60 into which is mounted a thrust bearing 62 that journals the forward end of shaft 42. Another plate 64 is mounted on the outer face of plate 58. The plate 64 is similar to the plate 54, and includes a quadrilateral opening 66 which exposes the counter-bore 60 and thrust bearing 62 in the end plate 58.

The driven shaft 42 extends from the coupler 48, through the end plate 51 and plate 54 and further extends toward the end plate 58. As shown in FIG. 8, the driven shaft 42 extends toward the end plate 58 and can be journalled in the opening of the end plate 58. As will become apparent below, the drive shaft's radial position will be maintained by elements surrounding the shaft 42. Hence, the shaft 42 need not extend to the end plate 58 to be journalled in the end plate opening.

A first (or rotating) cam 70 (as shown in FIG. 9) is rotationally fixed to the driven shaft 42, and is positioned on the driven shaft 42 such that an end face is proximate, if not in contact with, the thrust bearing 62. Because the cam 70 is rotationally fixed to the driven shaft, the cam 70 is rotated by the motor 38. A second (or reciprocating) cam 72 is mounted coaxially on the driven shaft 42, however, it is not rotationally fixed to the driven shaft. Hence, the shaft 42 and the first cam 70 can rotate with respect to the second cam 72.

Figure 14A:
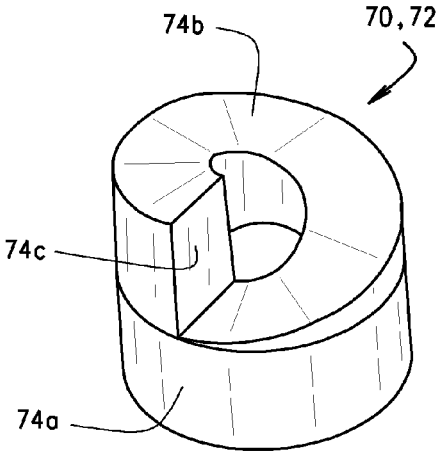
FIGS. 14A and 14B are top perspective and side elevational views of a cam of the impactor.
Figure 14B:
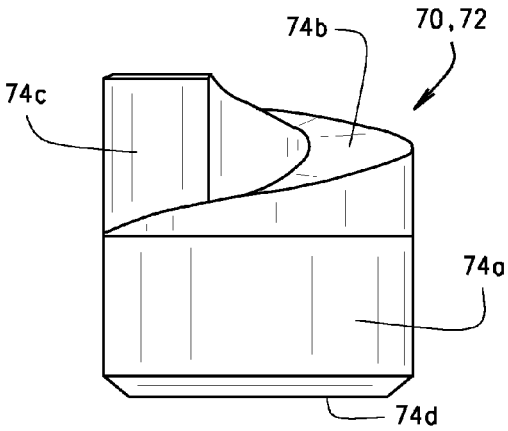
Figure 15A:
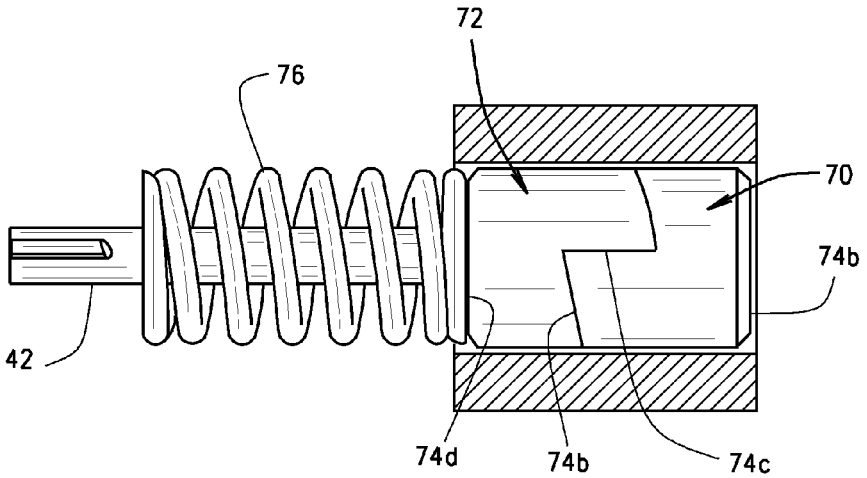
FIGS. 15A-15C are three views of the cams and hammer of the impactor, showing the cams at an at rest position, at a partially separated position, and at a nearly primed position.
Figure 15B:
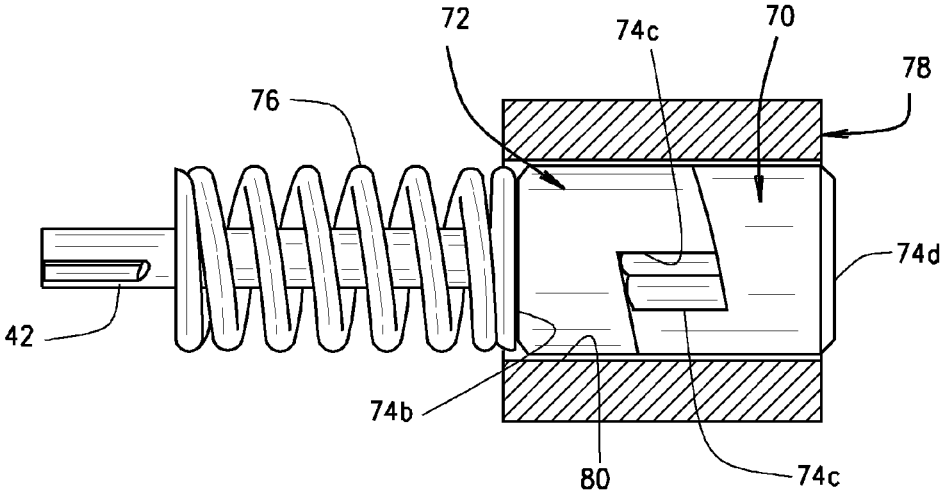
Figure 15C:
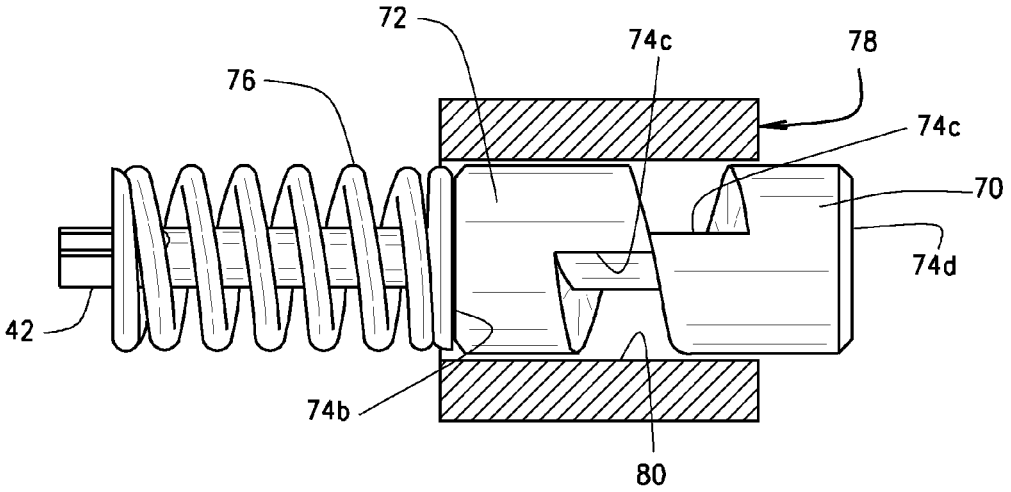

The first and second cams 70, 72 are nearly identical to each other. With reference to FIGS. 14A, 14B, the cams 70,72 each have a side surface 74*a*, a ramp surface 74*b*, an axial wall 74*c* which extends between the beginning and end of the ramp surface 74*b*; and an end face 74*d* opposite the ramp surface 74*b*. The first and second cams are arranged such that their ramped surfaces 74*b* face each other as best seen in FIGS. 15A-15C. A spring 76 extends between the end face of the second, reciprocating cam 72 and the end plate 51 mounted to the coupler housing 46. The spring 76 is received in the counter-bore 52 of the end plate 51. As can be appreciated, the spring 76 axially biases the ramped surface 74*c* of the second cam 72 against the ramped surface 74*c* of the first, rotating, cam 70. To the extent that the second cam 72 is moved axially by rotation of the first cam 70, the second cam 72 can be termed a cam follower.

As shown in FIGS. 15A-15C, a hammer 78 is mounted to the second cam 72 and is rotationally fixed thereto. The hammer 78 has a central hole 80 which is sized and shaped to receive (or surround) both the first cam 70 and the second cam 72. The hammer 78 is sized to extend to the surface of the end plate 58 when the impactor is at an "at rest" position, as shown in the Figures. As noted, the hammer 78 is mounted to the second cam 72. The fit of the second cam 72 in the hammer hole 80 can be a tight fit, such that the hammer and cam are fixed together both axially and rotationally. Alternatively, the hammer 78 can be welded to the second cam 72, or one or more pins can extend radially through the hammer into the second cam 72. Any other means for positively securing the hammer 78 to the second cam 72 can be used. In another alternative, the cam 72 can be formed integrally with the hammer 78. In this instance, the hammer 78 would include an internal shoulder (i.e., and end wall to the hammer hole 78) which would define the ramped surface 74*b* of the second cam 72. The hammer hole 80 is sized (at least at the forward end of the hammer) such that the hammer 78 can easily move axially relative to the first cam 70. Hence, the first cam 70 has an outer diameter that is slightly smaller than the inner diameter of the hammer hole 80 at the forward end of the hammer 78. Further, the second cam 72 is mounted axially within the hammer such that a recess is formed in the back end of the hammer 78 between the end face 74*d* of the second cam 72 and the back face of the hammer 78. The spring 74 is received in this recess. The recess could alternatively be integral to the hammer 78.

Figure 13:
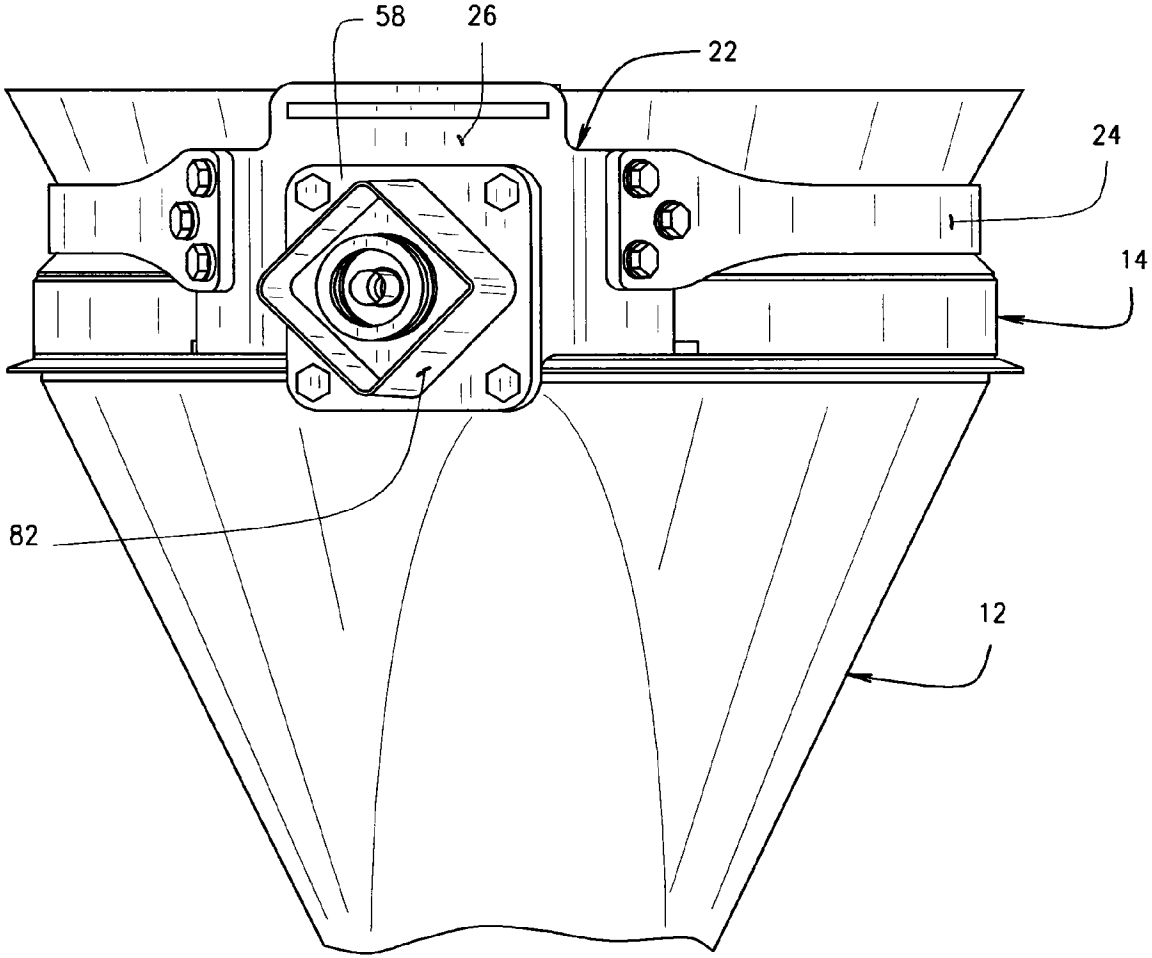
FIG. 13 is a vertical cross-section of the impactor taken along line 13-13 of FIG. 9.

As shown in FIG. 13, a guide sleeve 82 extends between the two plates 54 and 58. The guide sleeve 82 has an external shape, at least at its opposite ends, sized to be received within the quadrilateral holes 54 and 64 of plates 54 and 64, respectively, such that the openings 54 and 64 rotatably constrain the guide sleeve 82 within the housing 36. The guide sleeve 82 has an inner surface that is shaped correspondingly to the outer surface of the hammer 78. As best seen in FIG. 13, the guide sleeve 82 has a generally quadrilaterally shaped inner surface and the hammer 78 has a generally quadrilaterally shaped outer surface. As can be appreciated, the guide sleeve 82 prevents the hammer 78 from rotating, thereby preventing the second cam 72 from rotating as the first cam 70 is rotated. Hence, as the first cam 70 is rotated by the motor 38, the interaction of the ramped cam surfaces of the cams 70,72 will cause the second cam 72 to move axially rearwardly against the bias of the spring 76, thereby pulling the hammer 78 away from the plate 58 (as seen in FIG. 15B). When the vertical walls 74*c* of the two cams come into alignment (essentially just after the position shown in FIG. 15C), the spring 76 will force the second cam 72 and the hammer 78 forwardly causing the hammer 78 to impact the end plate 58. Hence, the end plate 58 functions as a strike plate impacted by the hammer. Continued operation of motor 38 causes repeated blows of the hammer on the strike plate generate repeated impact vibrations which are transmitted to the outlet hopper 10 and to the transition 12 through the bracket plate 26, the bracket upper and lower legs 30, 32, and the straps 24. These vibrations will be generally radially directed.

As can be appreciated, as the motor continues to operate, the interaction of the ramped surfaces of the cams 70,72 and the spring 76 will cause the hammer 78 to reciprocate axially within the sleeve 82 and the hammer will repeatedly impact or pound against the end plate 58 on a periodic basis. In an at rest position for the hammer, there is a slight gap between the ramped surfaces 74*c* of the two cams 70 and 72. Thus, when the second cam 72 and hammer 78 are forced forwardly under the pressure of the spring 76, the second cam 72 will not impact the first cam 70. Additionally, it is noted that the material from which the coupler 44 is made and/or the mechanical configuration of the coupler will, at least in part, vibrationally insulate the motor from the hammer 78. Hence, the vibrations generated by the impact of the hammer 78 on the end plate 58 will not adversely affect the motor 38.

The force generated by the impact of the hammer 78 on the end plate 58 is determined by the mass of the hammer 78 and the speed at which the hammer impacts the end plate. This speed, in the illustrative embodiment disclosed, is based on the characteristics (i.e., the spring constant, k) of the spring 76, and the amount that the spring is compressed. Hence, the force generated by the impact of the hammer on the end plate 58 (and thus the vibrational energy imparted into the outlet hopper to breakup bridging) can be altered by using a hammer of a different mass, using a spring with different characteristics, or altering the slope of the ramped surfaces 74*b* of the cams to alter the extent to which the spring 76 is compressed.

The speed of the motor 38 is controlled so that the vibrations generated by the hammer 78 impacting the end plate 58 and which are transferred to the outlet hopper do not create harmonics or frequencies in the outlet hopper, which could adversely affect the structural integrity of the outlet hopper of the bulk storage container (or other equipment) to which the outlet hopper is mounted. A period of about one impact/second (i.e., a rotational rate of the output shaft of 60 RPM) has been found to be sufficient to break up most bridges or voids that may form in the hopper outlet 10 and/or in transfer member 12 of the bulk storage container, where the flowable material is grain, such as wheat, corn or soybeans. However, it will be understood that for different flowable materials other than such grains, or grains having different flow characteristics, or for outlets having a different shape or flow characteristics, one skilled in the art would know to vary the speed and force of the repeated impact loads applied to the container.

Figure 16:
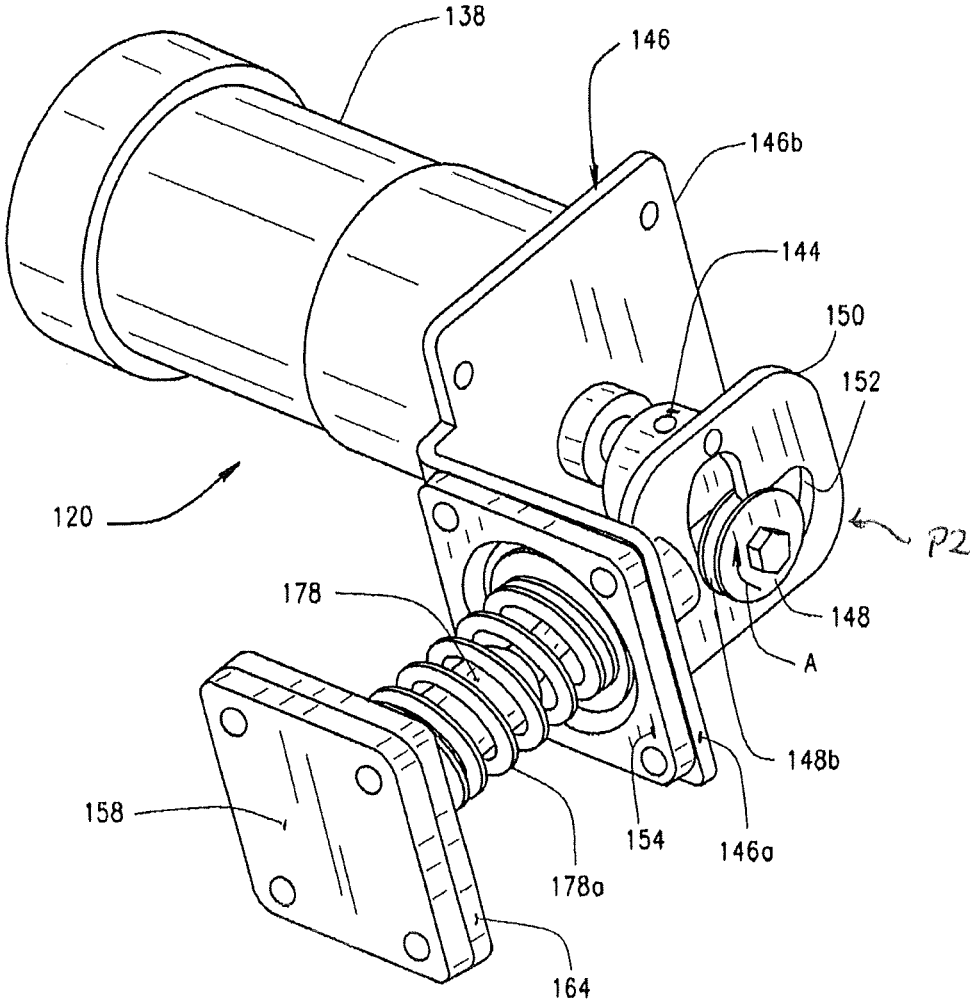
FIG. 16 is a perspective view of a second illustrative embodiment of the impactor, with a guide sleeve and housing removed for purposes of showing the impactor.
Figure 17:
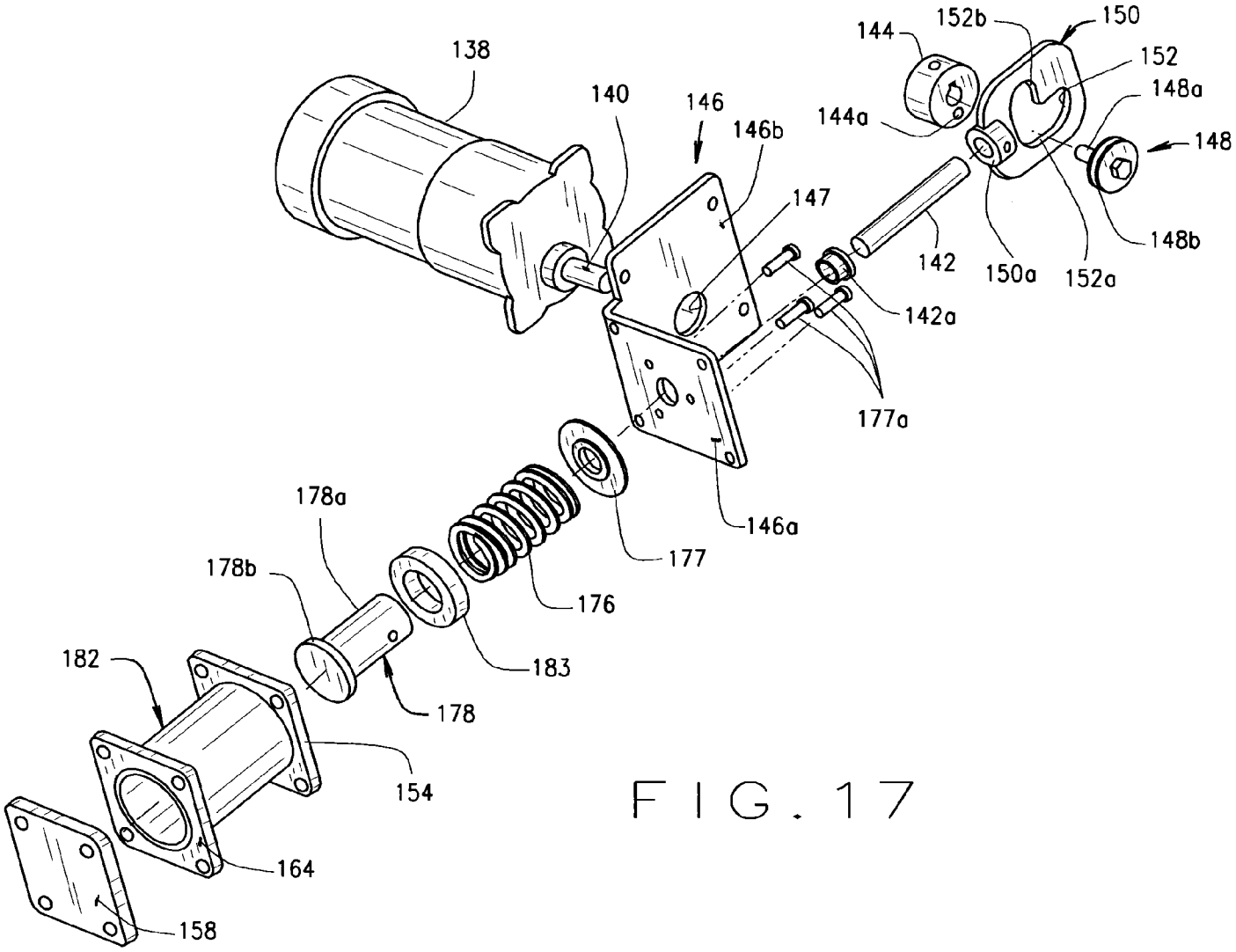
FIG. 17 is an exploded view of the impactor of FIG. 16.
Figure 18:
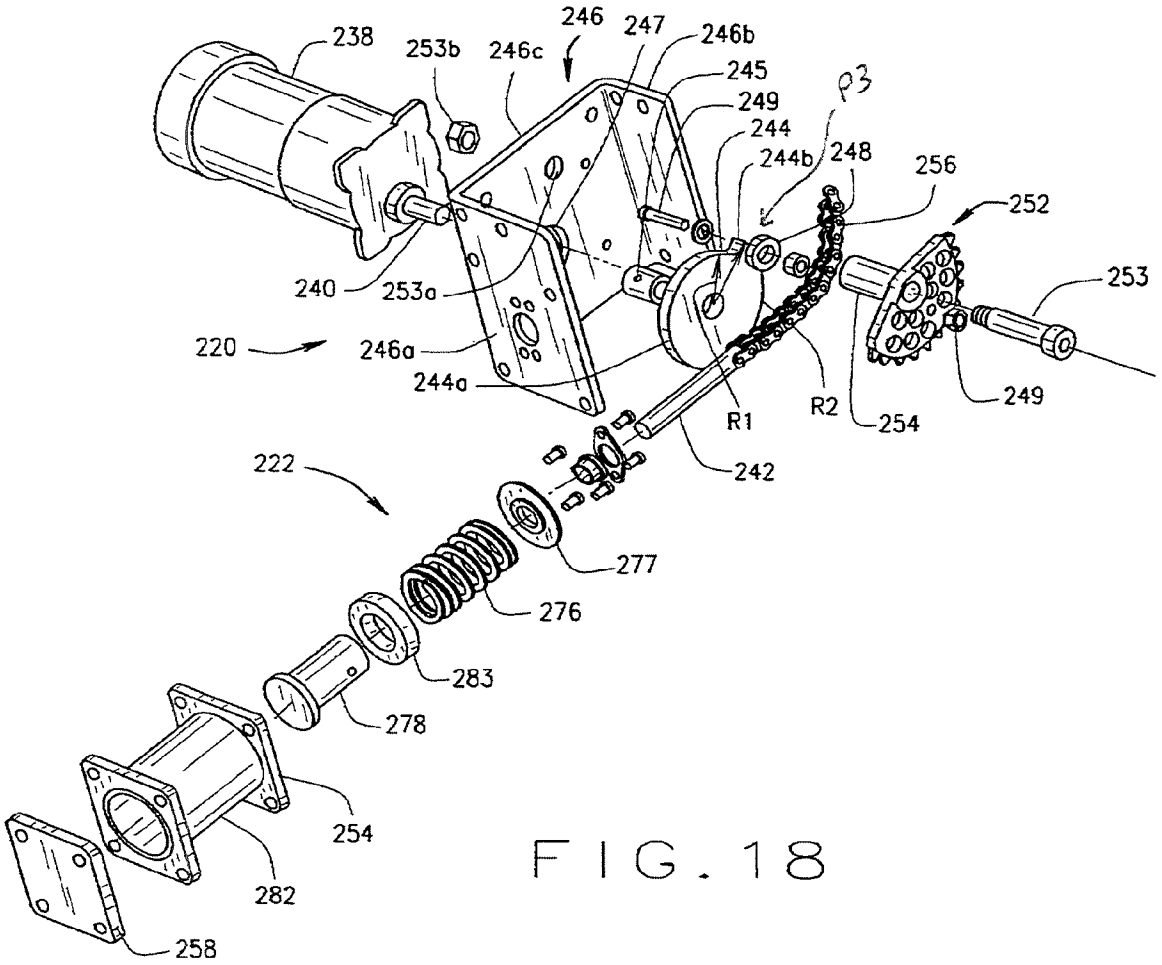
FIG. 18 is an exploded perspective view of the impactor with a chain and sprocket drive for the hammer.
Figure 19:
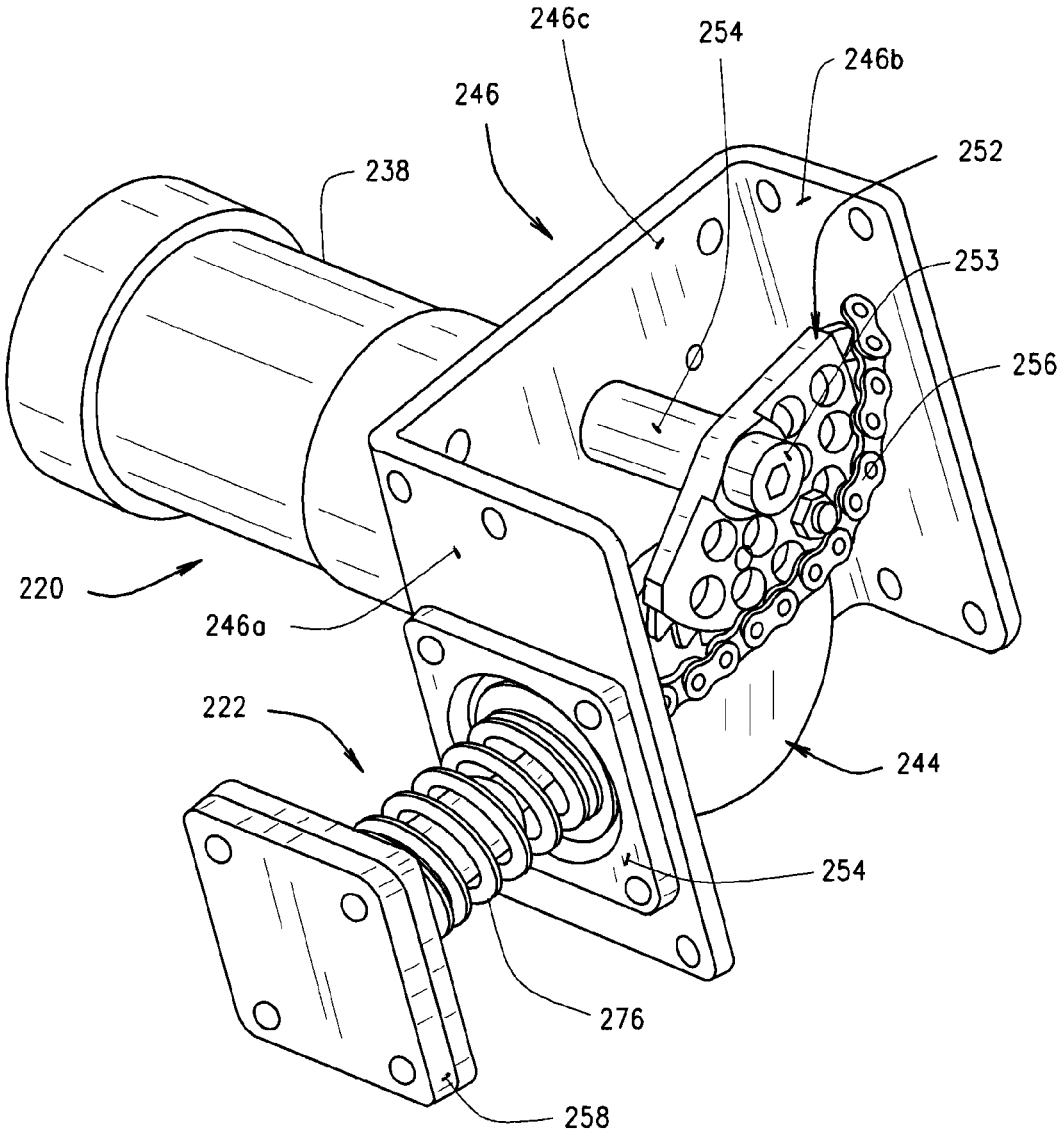
FIG. 19 is a perspective view of the impactor with the chain and sprocket drive, the drive housing being opened to show the elements of the drive.
Figure 20:
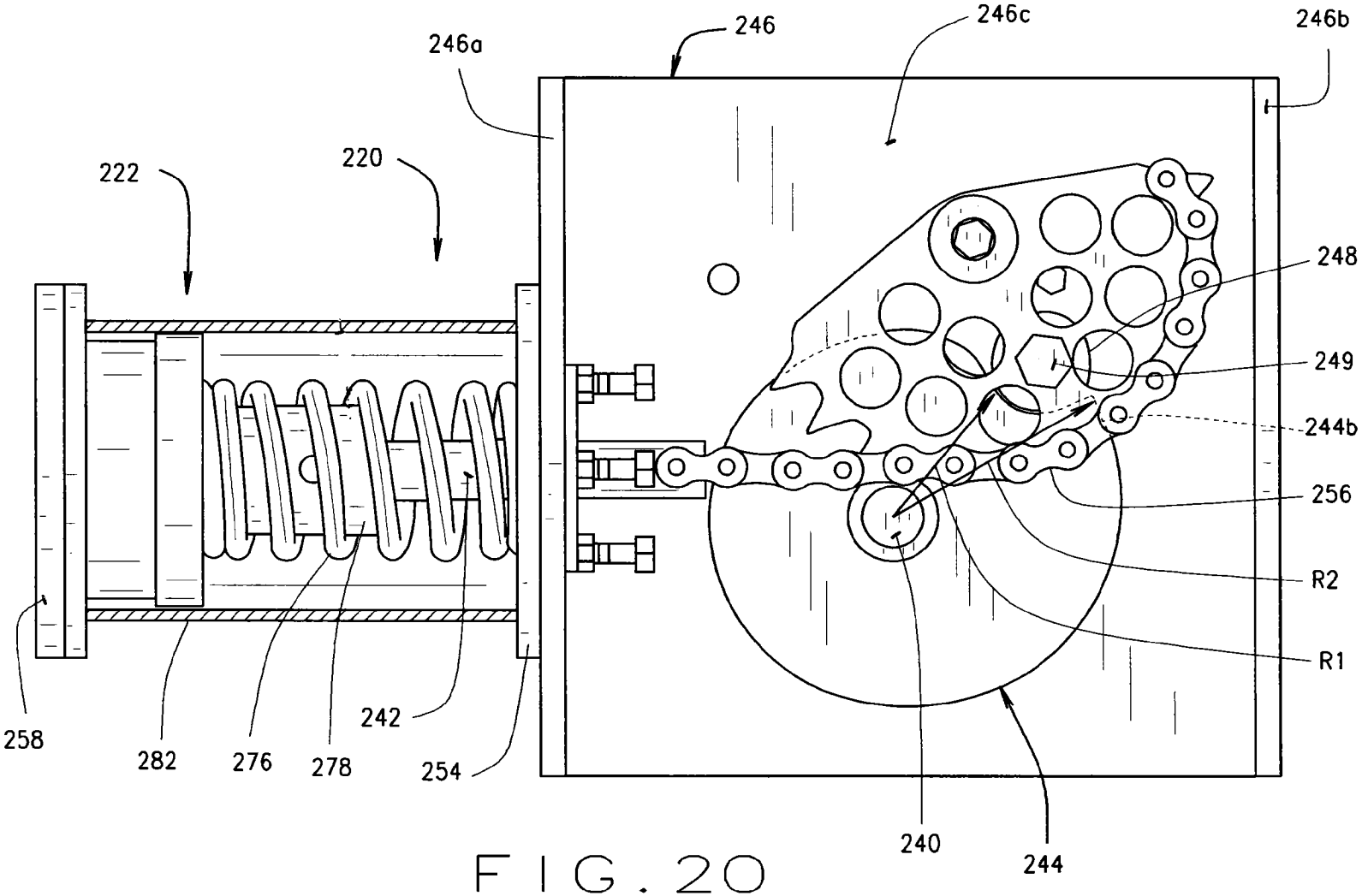
FIG. 20 is a side elevational view of the impactor and chain and sprocket drive.

Turning to FIGS. 16 and 17, a second illustrative embodiment of the impactor of the present disclosure is shown and is indicated generally at 120. The impactor 120 includes a strike plate 158, which is secured to mounting bracket 22. A guide sleeve 182 (see FIG. 17) having end plates 154 and 164 is secured to the strike plate 158 by means of fasteners (not shown) extending through the front end plate 164 into the strike plate 158. The guide sleeve 182 is shown to be cylindrical, but it will be understood that it could be of a different cross section.

A hammer 178 is received in the guide sleeve 182 for reciprocal motion relative to the guide sleeve. The hammer 178 includes a body or shank 178*a* and a head 178*b* affixed to the shank. The body 178*a* is smaller in diameter than the guide sleeve 182. The head 178*b* is larger in diameter than the body 178*a*, and is sized such that it easily slides or can be reciprocated within the bore of guide sleeve 182. A guide washer 183 is received in the guide sleeve. The guide washer 183 has an inner diameter sized to receive the body 178*a* of the hammer 178. The guide washer 183 supports the hammer body 178*a* within the guide sleeve 182 and helps to maintain the radial position of the hammer body within the guide sleeve. To this end, the guide washer is positioned in the sleeve a point rearwardly of the hammer head when the hammer is at a back end of its reciprocal path of travel, but forward of the back end of the hammer body when the hammer is at a front end of its reciprocal path of travel. To facilitate reciprocal axial movement of the hammer 78 within the guide sleeve, guide washer 183 is preferably made from a low-friction material, such as nylon or other suitable synthetic resin material well known to those skilled in the art. To further facilitate movement of the hammer within the guide sleeve, the hammer can be made from a low friction material, or the hammer can be coated along its side surfaces with a low friction material. Those skilled in the art will understand that other methods of lubrication may be used.

A shown in FIGS. 16 and 17, a motor mount 146 is secured to the back plate 154 of the guide sleeve 182. The motor mount is generally L-shaped and includes a first plate 146*a* which is secured to the guide sleeve end plate 154, and a second plate 146*b*. A motor 138 is secured to the mount plate 146*b* to which motor 138 is secured. As shown in FIG. 17, the motor's output shaft 140 extends through a center opening 147 in the plate 146*b*. A cylindrical member 144 is fixedly mounted on motor output shaft 140 to be rotationally driven by the output shaft. The member 144 includes an off-center hole 144*a* that receives a mounting shaft 148*a* on which an orbitally driven disk 148 (also referred to a circular driven member) is mounted. Disk 148 is preferably in the shape of a grooved pulley having a circumferential groove 148*b*. As the output shaft 140 drives member 144, member 148 will be driven in a circular orbit or path offset from the axis of shaft 140 (i.e., it rotate about the axis of the motor output shaft 140).

A plate 150 having a generally L-shaped opening or slot 152 therein is provided. The groove 148*b* of member 148 receives the edges of plate 150 defining opening 152. This opening or slot 152 is generally L-shaped having a horizontal edge or portion 152*a* and a vertical edge or portion 152*b*. As can be appreciated, the groove 148*b* of the disk 148 rides on the edges of the slot 152. However, the plate 150 could be formed such that the slot 152 has a grooved edge, and that the grooved edge of the slot receives the edge of the disk 148. In this instance, the edge of the disk 148 would not be grooved.

At its forward edge, the plate 150 includes a mounting ring or hub 150*a* which receives a driven shaft 142. The driven shaft 142 is fixed in the ring 150*a*, for example, by means of a pin (not shown) that extends through the ring or hub and through shaft 142. The shaft 142 extends through an opening (not numbered in FIG. 17) in mounting plate 146*a*. The hammer 178 has a center bore (not shown in the drawings) that receives shaft 142, and the shaft can be secured to the hammer by means of pins, for example, which extend radially through the hammer body 178*a* and shaft 142. A bronze bushing 142*a* can be placed in the opening of the mounting plate 146*a* to facilitate sliding/reciprocal motion of the shaft 142 and to maintain the shaft centered with respect to hammer 178.

As noted above, because disk 148 is attached to member 144 by stud 148*a* such that the stud is offset from the axis of rotation of disk 148, the disk is driven in an orbital or eccentric path by the motor. With reference to FIG. 16, the eccentric path of member 148 will be generally clockwise, as indicated by the arrow A. In FIG. 16, the hammer 178 is shown at an at rest position, with the hammer head 178*b* in contact with the strike plate 158. In this position, the disk 148 is received in the horizontal portion 152*a* of the slot 152 in the plate 150. As the disk 148 moves along its clockwise orbital path, the disk 148 will move forwardly (toward hammer 178) relative to the slot horizontal portion 152*a*. As the disk 148 moves upwardly in its orbital path, the disk 148 will engage the vertical portion 152*b* of the opening 152. As the disk 148 continues on its orbital path, the interaction of the disk with the slot vertical portion 152*b* will cause the plate 150 to move rearwardly (i.e., away from the plate 146*a*). This rearward movement of the plate will then cause the driven shaft 142, and hence the hammer 178, to move rearwardly as well. As the disk 148 completes is orbit, the disk will descend from the vertical portion 152*b* of the slot 152 into the slot's horizontal portion 152*a*. When the disk enters the slot horizontal portion, the disk is at the forward end of the slot 152*a*. When the disk 148 is at the forward end of the slot 152*a*, the hammer 178 will be at the back of its reciprocal path. The compression coil spring 176 will thus forcefully and rapidly propel hammer 178 forwardly such that the hammer head impacts against the strike plate 158 to send Impact energy and vibrations radially into the container as described above. When the hammer 178 is moved forwardly, the forward motion of the hammer 178 will move the plate 152 relative to the disk 148, such that the disk 148 will not be at the back of the horizontal slot 152*a*. Thus, as the disk 148 moves in its orbital path, it will pull the hammer back to "prime" or "cock" the hammer for impacting the strike plate 158. When the disk 148 is about at the 3:00 position, the disk will descend into the forward part of the horizontal opening 152, at which point, the spring will rapidly and forcefully propel the hammer forward from its primed position to its striking or at rest position.

A third embodiment of an impactor of the present disclosure is shown in FIGS. 18-22, and is indicated in its entirety by reference character 220. Specifically, impactor 220 includes a hammer assembly 222, which includes a hammer 278, a compression coil spring 276, a guide sleeve 282, a guide washer 283, a strike plate 258, and an adjustment plate 277. The hammer assembly 222 is substantially the same as the hammer assembly described in conjunction with the impactor 120, and thus will not be described in detail. In the impactor 220, the guide sleeve 282 is mounted to a generally channel or U-shaped housing member 246 which has a front wall 246*a*, a back wall 246*b* and a side wall 246*c* of a drive housing. The guide sleeve 282 is secured to the housing member front wall 246*a*, and a hole is provided in the wall 246*a* through which the driven shaft 242 extends. The motor 238 is mounted to the housing member side wall 246*c*, and the motor's output shaft 240 extends through a hole 247 in the side wall 246*c*.

A cam 244 is operatively connected to (rotatably driven by) motor output shaft 240. The cam 244 has a side edge defining a cam profile surface 244*a*. The cam profile 244*a* has an increasing radius as the cam profiled increases in counter-clockwise direction (as viewed in FIG. 18) having it shortest radius R1 at the beginning of the cam profile 244*a* and its longest radius R2 at the end of the cam profile, with an abrupt transition or concave surface 244*b* therebetween that sharply decreases in radial distance from the end of the cam profile 244*a* to the beginning of the cam profile over a relatively short circumferential distance. A spacer 245 spaces the cam 244 from the housing member wall 246*c* and can be used to fix the cam to the motor output shaft 240 so that the motor 238 will rotationally drive the cam.

Figure 22:
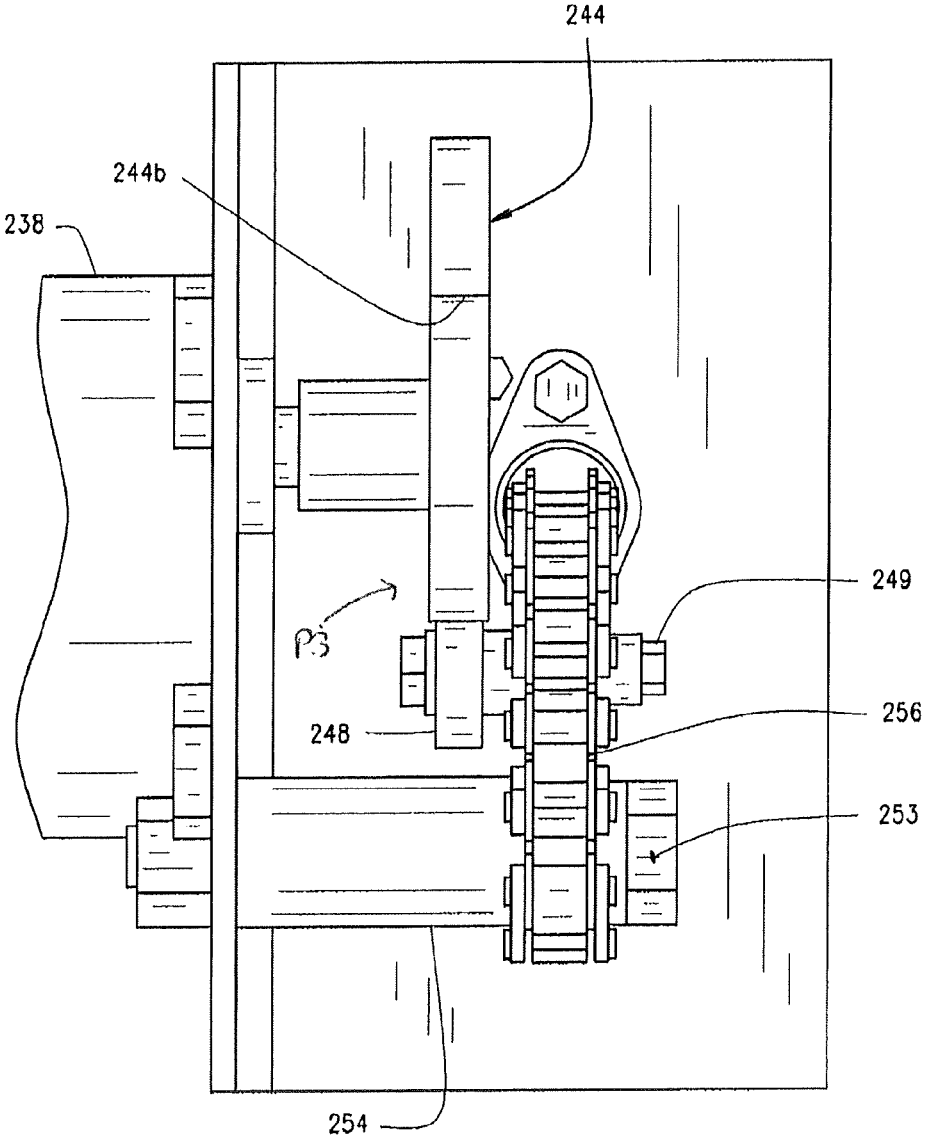
FIG. 22 is a top plan view of the chain and sprocket drive.

A disk 252, in the form of a partial chain sprocket, is rotatably mounted to the housing member wall 246*c* to rotate about an axle 253 that extends from the member wall 246*c*. The axle is shown to be a bolt having a threaded end which passes through an opening in the housing member wall 246*c* to secure the bolt/axle (and hence, the disk 252) to the housing member wall 246*c*. As best shown in FIG. 22, a spacer 254 spaces the disk 252 farther from the wall 246*c* than the cam 244. The spacer 254 is shown to be a hollow shaft or tube which can be integral with the disk 252 and which receives and journals axle 253. The distal end of axel 253 extends through a hole 253*a* in plate 246*c* and is secured by a nut 253*b*. As seen, the disk or sprocket 252 is only a part of a circular disk. A flexible connecting tension member 256 (e.g., a chain segment) is affixed to the sprocket segment 252 and is in mesh with sprocket teeth on the periphery of the sprocket segment 252. The opposite end of the flexible connecting tension member 256 is fixed to an end of the driven shaft 242. In view of the fact that the disk 252 in the illustrative embodiment is a sprocket, the flexible connecting member takes the form of a chain. It will be apparent that the sprocket could be replaced with a grooved disk (e.g., a pulley). While tension member 256 is shown to be a segment of a chain, it could be made of any material which has sufficient tensile strength and will with stand the environment to which the cord will be exposed. For example, the cord could be made from wire or a polymer, in which case it would wrap around the periphery of the disk segment, but it would not be in mesh with any sprocket teeth on the disk segment.

Figure 21:
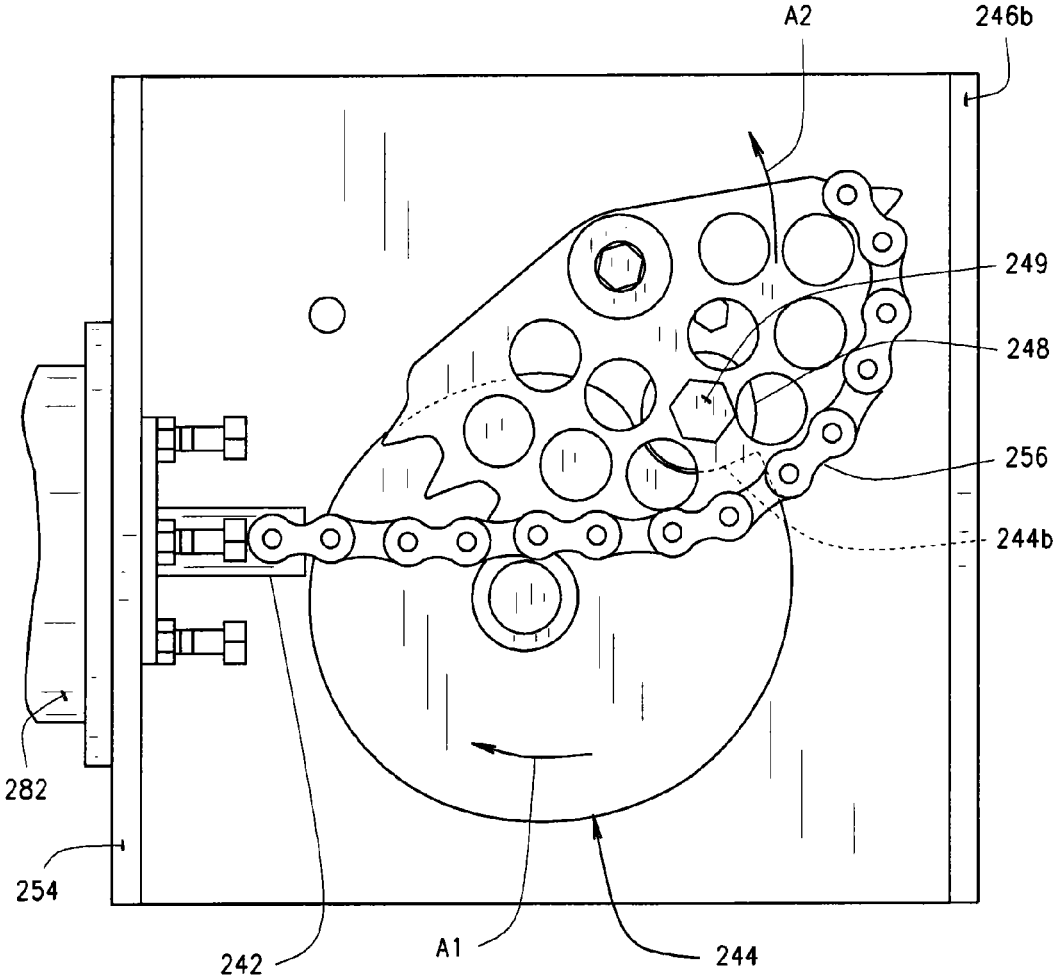
FIG. 21 is a view similar to FIG. 19, but with the sprocket shown transparent to see the drive mechanism for the sprocket.

A cam follower 248, in the form of a wheel or bearing, is rotatably mounted to the inner surface of the disk 252, radially spaced from the disk's axle 253. That is, the cam follower 248 is not located at the axis of rotation for the disk, but rather is offset from the disk's axis of rotation. The cam follower 248 is mounted to the disk by means of an axle 249 (which can be a bolt, for example) so that the cam follower 248 can rotate about its axle relative. As best seen in FIG. 21, the cam follower 248 is positioned on the sprocket to be in camming engagement with cam surface or profile 244*a* of the cam. As shown, the cam surface 244*b* and the cam follower 248 have similar or complementary curvatures, such that the cam follower 248 can nest in the concave cam surface 244*b* between the shortest and longest radii of the cam R1 and R2, respectively.

As the cam 244 rotates in a clockwise direction, as shown by the arrow A1 in FIG. 21, the increasing radius of cam surface 244*a* forces cam follower 248 to the right and thus causes the chain sprocket segment or disk 252 to rotate in a counter-clockwise direction (again with reference to FIG. 21) as shown by arrow A2. As can be appreciated, as the chain sprocket segment 252 rotates in counter-clockwise direction, the connecting member 256 (e.g., the chain) will be wound on to the periphery of the sprocket segment 252 and will pull the drive shaft 242 to the right against the bias of spring 276 so as to thus prime or cock the hammer. As the cam completes nearly a full rotation (i.e., when the cam follower 248 moves along the cam profile 244*a* from the minimum radius R1 to the maximum radius R2) and first encounters the top of the concave cam surface 244*b*, the cam follower will suddenly move down the concave cam surface so that the sudden change in radius will release the spring 276 thus allowing the hammer 278 to suddenly move from its cocked position so as to impact strike plate 258. Of course, as motor 238 continues to rotate, the hammer will, in this manner, deliver repeated blows to the strike plate.

Figure 23:
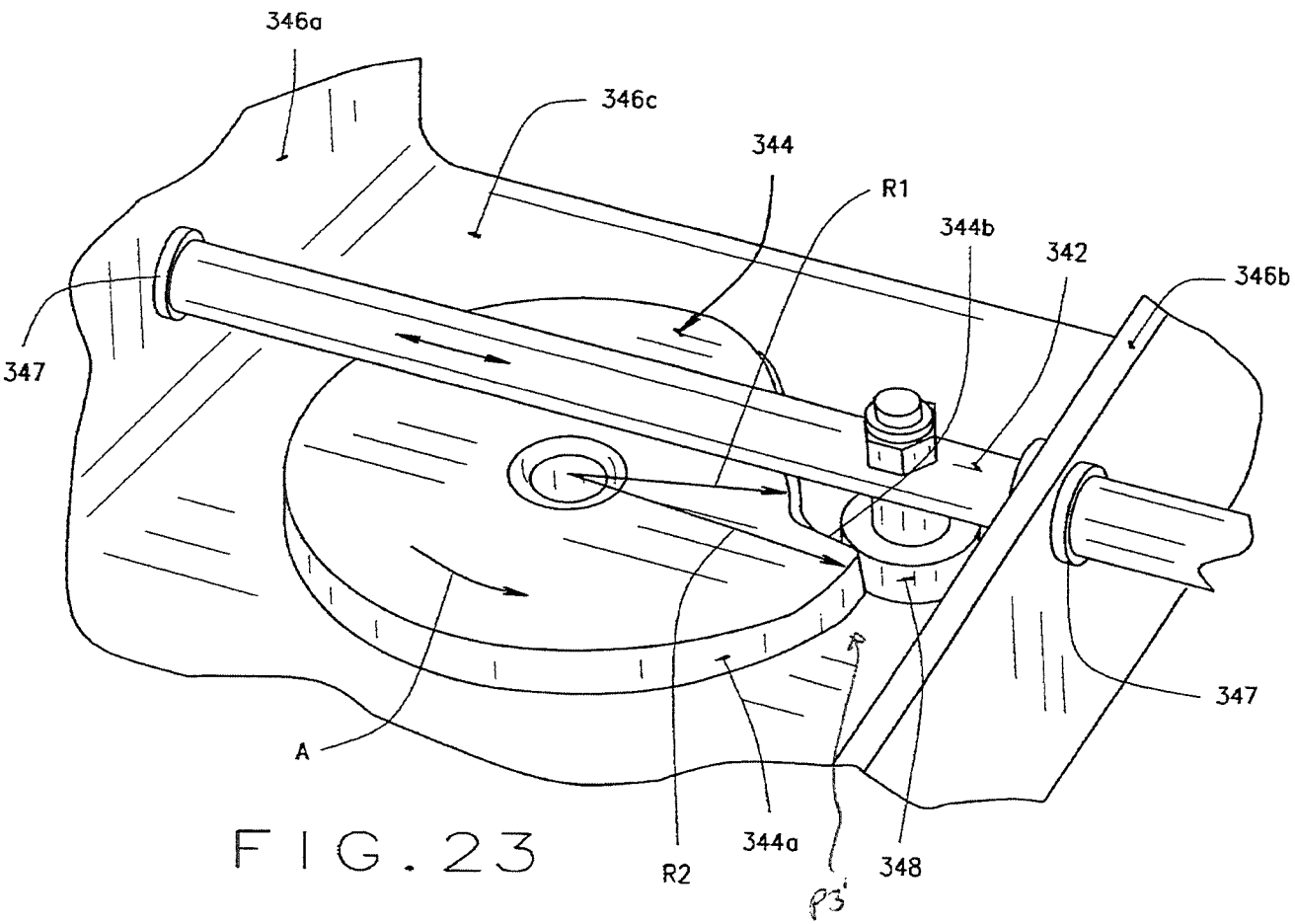
FIG. 23 is a perspective view of a cam drive for the hammer of the impactor.

Another alternative drive is shown in FIG. 23. This drive utilizes the same hammer assembly 222 as utilized by the embodiments of FIGS. 18-22. This drive is mounted to a channel housing member 346 having a front wall 346*a*, a back wall 346*b* and a side wall 346*c*. The housing member 346 is similar to the housing member 246. A cam 344, identical to the cam 244, is rotationally driven by the motor 238, the motor being mounted to the wall 346*c* of the housing member. In this version, the reciprocating shaft 342 (or an extension connected to the drive shaft) extends through the drive housing, and is shown to be journalled in both the front and back walls 346*a* and 346*b* of the housing member 346 by means of bushings 347. A cam follower 348, in the form of a bearing or wheel, is mounted to the shaft 343 and is positioned to engage the cam surface 344*a* of the cam. The cam profile 344*a* of cam 344 is similar in shape and operation to cam 244. The cam follower 348 is mounted to the driven shaft 342 by means of an axle to allow the cam follower to rotate about its axle relative to the driven shaft in a plane parallel to the plane of the cam 344. As can be seen in FIG. 23, as the cam 344 rotates in the direction indicated by the arrow A (i.e., in counter-clockwise with reference to FIG. 23), spring 376 biases the cam follower into engagement with cam surface 344*a*. As the cam is rotated in counter-clockwise direction, as shown in FIG. 23, the cam follower is forced by the increasing radius of the cam surface 244*b* away from housing wall 346*a* and will thus move shaft 342 to the right so as to compress spring 376 thus priming or cocking hammer 378. As the cam 344 completes one revolution (i.e., when the cam follower reaches the end of the cam surface 344*a*) and as the cam follower encounters the decreasing radius cam surface 344*b*, the shaft under the bias of spring 376 moves rapidly to the left (as viewed in FIG. 23) thus abruptly releasing the hammer to impact the strike plate. Of course, continued operation of motor 282 would continue to rotate cam 344 and would thus cause the shaft 342 to reciprocate, as shown by the arrow in FIG. 23, to cause the hammer to repeatedly impact the strike plate and to deliver repeated impact blows to the container that tend to break up bridges of material or voids and to thus insure the uniform flow of material from the container.

Figure 24:
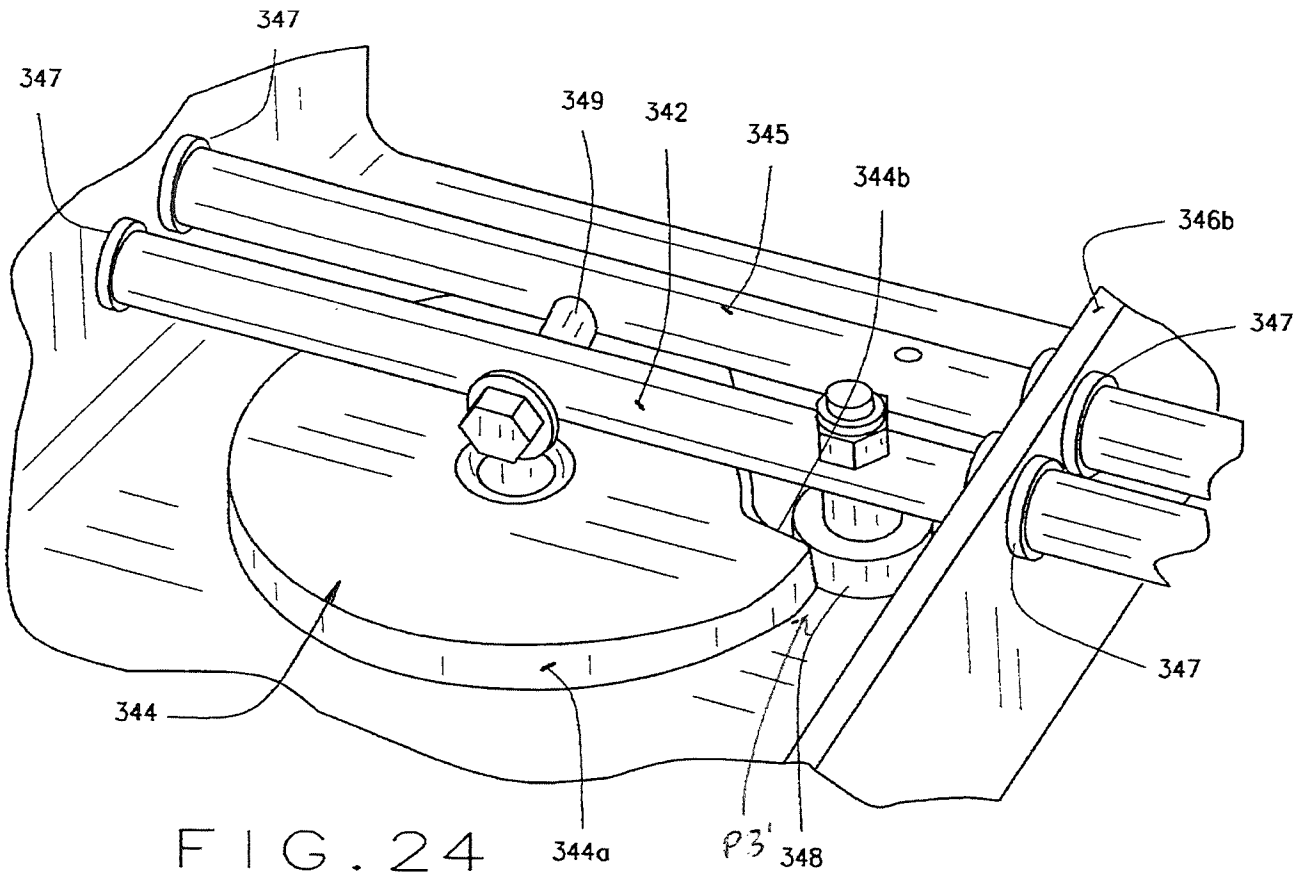
FIGS. 24 and 25 show variations of the cam drive with solutions for preventing rotation of a shaft.
Figure 25:
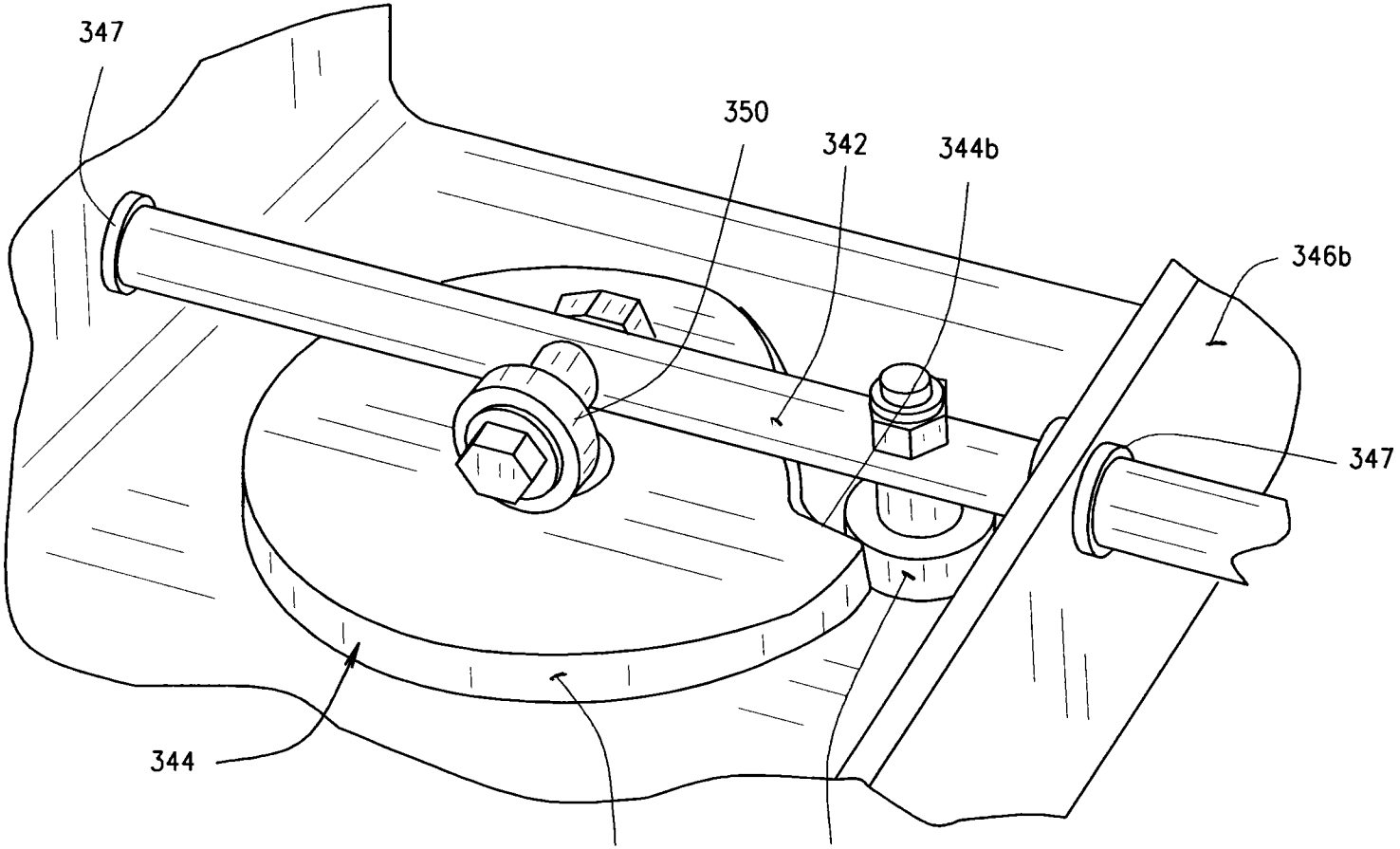
Figure 26:
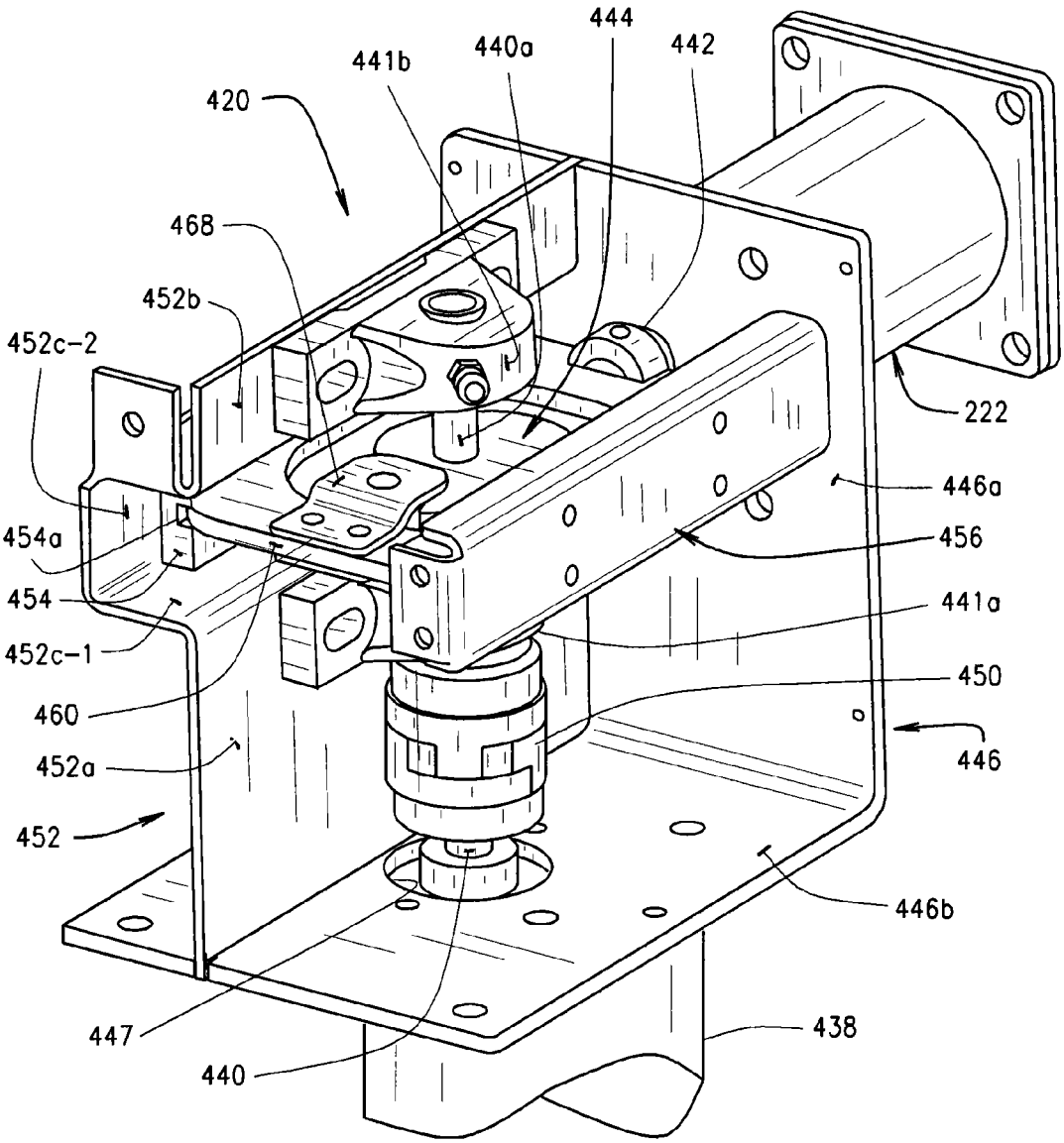
FIG. 26 is a perspective view of an alternative cam drive, with portions of the drive housing removed to show the drive elements.
Figure 27:
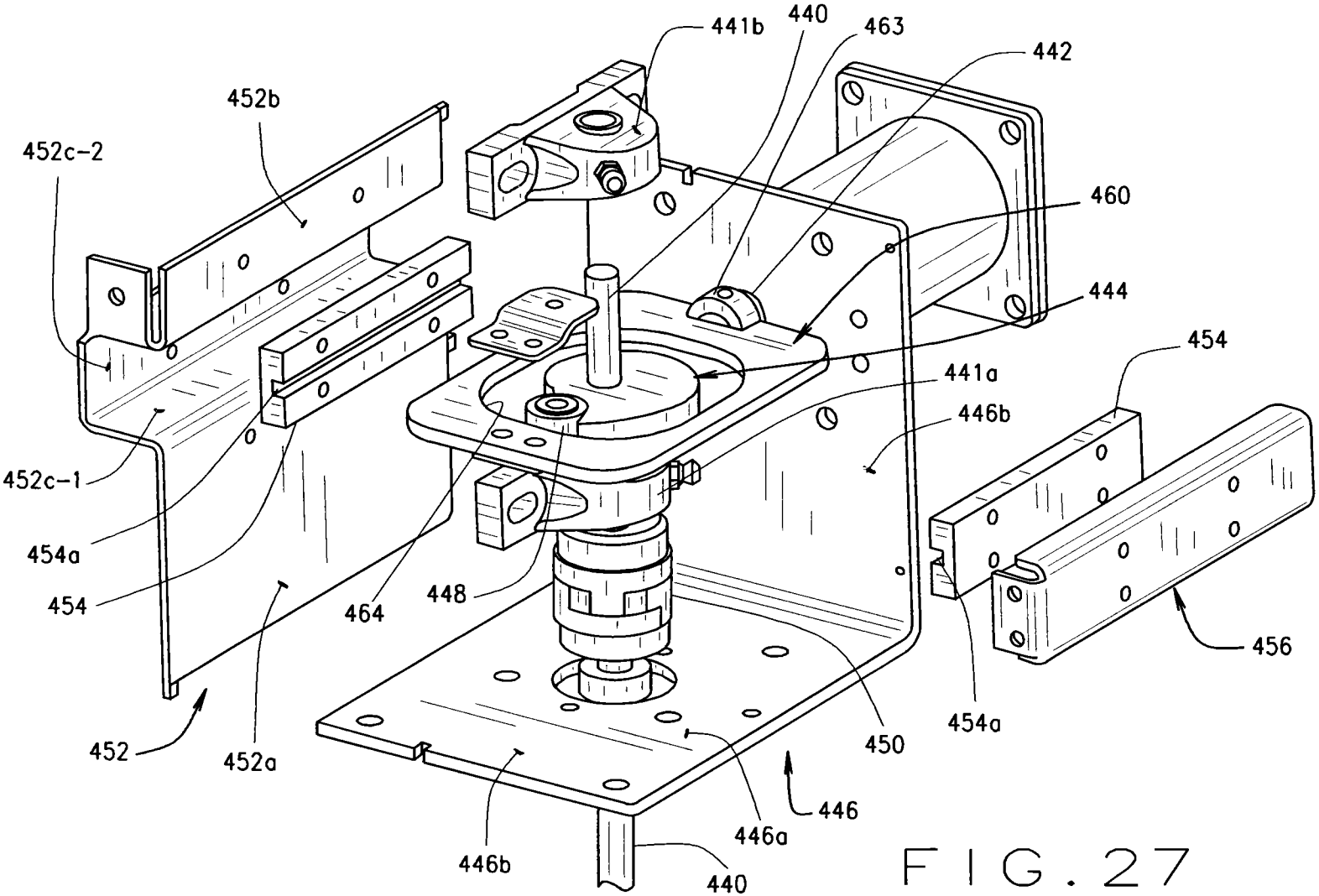
FIG. 27 is a partially exploded view of the cam drive of FIG. 26.

In FIG. 23, the driven shaft 342 is shown to be round, and thus could be susceptible to rotation. To prevent the shaft from rotating, the shaft can be provided with various anti-rotation means. Such anti-rotation means can be the shaft itself. That is, the shaft 342 can be made to be polygonal (or to otherwise have a flat surface) and the bearings or bushings that support the shaft in walls 346*a*, 346*b* would have a complementary shape so as to prevent the shaft from rotating. Alternatively, a rib can be formed on the shaft which rides in a groove in a bushing 347 through which the shaft is journalled. Or the rib (not shown) can be formed in the bushing and the groove can be formed in the shaft. Alternatively, as shown in FIG. 24, the anti-rotation means can comprise a guide shaft 345 journalled in the housing member 346 for translational movement relative to the housing member 346. The guide shaft extends parallel to the driven shaft 342, and the driven shaft 342 is fixed to the guide shaft 345. The use of two joined shafts coupled together by a bolt 349 will prevent the driven shaft 342 from rotating about its axis. The anti-rotation means can also comprise a bearing or wheel 350 rotationally mounted to the driven shaft, as seen in FIG. 25, and which rides on the cam. The bearing 350 rotates in a plane that is perpendicular to the plane of the cam 344. Although only one bearing or wheel is shown in FIG. 25, two bearings or wheels can be provided, with a bearing or wheel on opposite sides of the shaft 342.

FIGS. 26-29 show yet another drive, as indicated in its entirety at 420, which incorporates elements of the drive of FIG. 16 and the drive of FIG. 23. This drive includes an L-shaped mounting member 446, having two walls 446*a* and 446*b* which are generally at right angles relative to each other. A hammer assembly 222 is mounted the wall 446*a* and the motor 438 is mounted to the wall 446*b* of the L-shaped mounting member. As shown, motor 438 has a drive shaft 440 that drivers a coupler 450 similar to coupler 44 heretofore described. This hammer assembly can be generally similar to the hammer assembly 222 of FIGS. 16-18. The L-shaped mounting member 446 defines two sides or surfaces of a drive housing 446. The remaining sides or surfaces of the drive housing have not been depicted for purposes of clarity.

The driven shaft 442 of hammer 222 enters the drive housing through an aperture in the wall 446*a*, and the output shaft 440 of the motor 438 enters the drive housing through an aperture 447 in the wall 446*b* of the L-shaped mounting member 446. The motor output shaft 440 is coupled to a drive shaft 440*a* by means of a coupler 450, which is similar to the coupler 50 (described above). The drive shaft 440*a* is journalled in a pair of pillow block bearings 441*a,b*. A cam 444 is fixed to the drive shaft 440 and its cam surface 444*a* is in line with the driven shaft 442. The cam 444 is similar to the cams 244 (FIGS. 17-22) and to cam 344 (FIGS. 23-25) and thus will not be further described herein.

Figure 28:
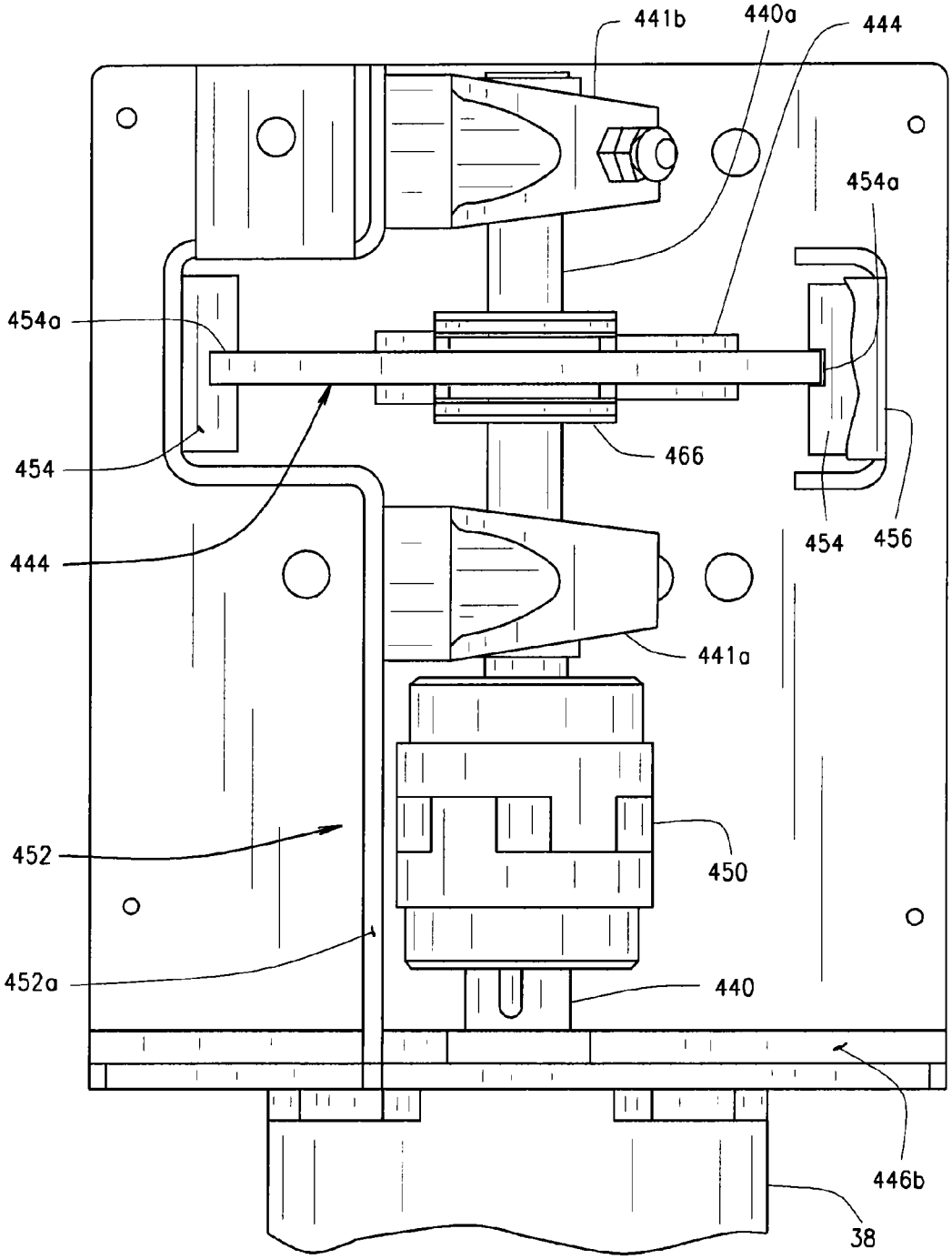
FIG. 28 is a side plan view of the cam drive of FIG. 26.

A side mounting plate 452 is mounted to the mounting member 446 to one side of the coupler 450 (as seen in FIG. 28. The side mount 452 includes a lower wall 452*a*, an upper wall 452*b* which is coplanar with the lower wall 452*a*, and a channel 452*c* defined between the lower and upper walls. The channel is formed by a lower surface 452*c*-1, a side wall or web 452*c*-2 and an upper surface 452*c*-3. The side mount is provided with pins and flanges to facilitate securing of the side mount to the surfaces of the drive housing, including the mounting member 446. The lower wall 452*a* of the side mount extends from the surface 446*b* of the mounting member 446 to a point beyond the coupler 450, and the bearing 441*a* is mounted to the lower wall 452*a* above the coupler 450 (with reference to FIG. 28). The second bearing 441*b* is mounted to the upper wall 452*b* of the side mount 452. Finally, a channel member 454 is mounted in the side mount channel 452*c*. The channel member 454 is shown as being secured to the side wall 452*c*-2 of the side mount channel 452*c*. The channel member 454 includes an elongate groove 454*a* that defines an open slot extending the length of the channel member for slidably receiving a plate 460, as will be described in detail. A second channel member 454 is secured to the wall 446*a* of the mounting member 446, such that the grooves 454*a* of the two channel members are aligned (i.e., generally co-planar). Further, the first and second channel members are positioned (and hence the channel 452*c* of the side mount 452 is positioned) such that the channel members 454 are generally aligned with the cam 444. The second mounting member 454 is mounted in a bracket 456 which is mounted at one end to the wall 446*a* of the mounting member 446. It is to be understood that the side mount 453 and the bracket 456 are mounted to a wall of the drive housing which would be opposite the wall 446*a* of the mounting member 446.

Figure 29:
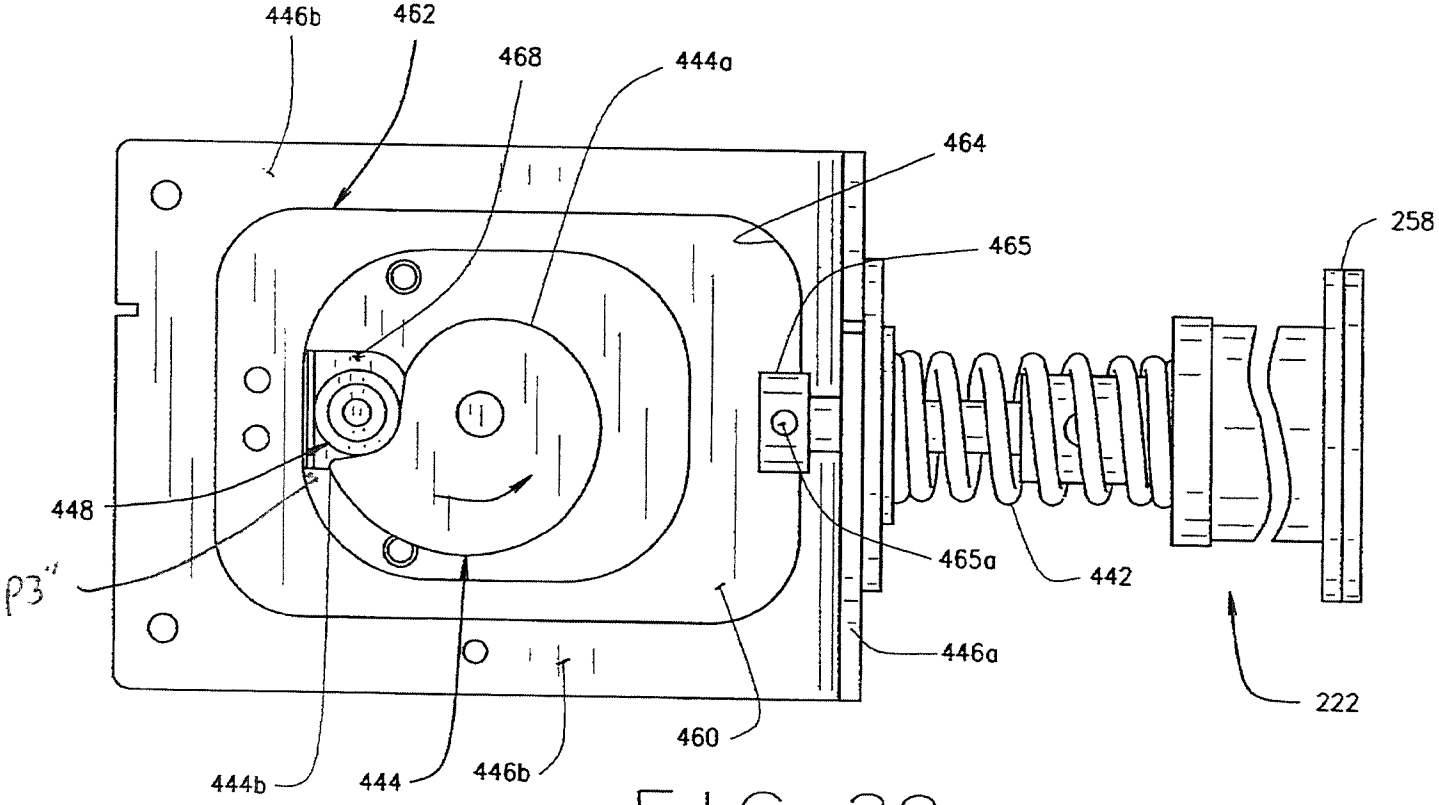
FIG. 29 is a top plan view of the cam drive of FIG. 26.

A cam follower 460, in the form of a slide plate, is slidably mounted in the grooves 454*a* of the two channel members 454. The slide plate 460 defines a cam follower opening 464 that is driven by the rotating cam 444 so as to cause shaft 442 to reciprocate and to move the hammer to its cocked position and then to suddenly release the hammer so as to impact the strike plate in hammer assembly 222 in the manner heretofore described. The slide plate 460 is positioned such that the cam 444 is received within the opening 464. Thus, the slide plate is generally aligned with the cam and the driven shaft 442. The plate 460 includes a connector 465, in the shape of a ring or collar, which enables the plate 460 to be fixedly connected to the driven shaft 442. For example, a pin 465*a*, screw, or the like can be driven through the collar 465 into the driven shaft 442. As best seen in FIG. 29, the opening 464 is generally rectangular, but with radiused corners. A cam follower roller 448, similar to cam follower 348, is mounted to the slide plate 460 by a bracket 468. As seen, the opening 464 in the plate 462 is sized, and the plate is positioned, such that the cam follower 448 will ride on the side edge of the cam 444. Hence, the surface of the opening 464 of the slide plate 460 engages the cam surface via the roller 466.

In operation, the motor 38 will rotationally drive the cam 444 in counter-clockwise direction, as shown by the arrow in FIG. 29. As the cam 444 so rotates, its cam surface 444*a* bears against cam follower 448 and thus the cam forces the plate 462 to translate rearwardly (i.e., away from the wall 446*a* of the mounting member 446) to thereby pull the driven shaft 442 and the hammer against the bias of the spring 246 within hammer 222 to its primed or cocked position. When the roller 448 reaches the end 444*b* (as best shown in FIG. 29) of the cam surface, the cam follower roller 448 is released and thus allows the spring 246 to rapidly propel the hammer forwardly to impact the strike plate of hammer 222. At the same time, the spring will pull the plate 462 forwardly, so that the cam follower 466 remains in contact with the cam surface of the cam 462. Of course, upon continued operation of motor 438, the hammer will deliver repeated impact blows.

As can be appreciated from the forgoing description, the impactor 20 relies on an electric motor 38, a primer or cocking system to move the hammer rearwardly and the spring 76 to reciprocally move the hammer 78. In the first embodiment, the primer or cocking system P1 includes the cams 70 and 72 (FIG. 8); in the second embodiment, the primer or cocking system P2 includes the orbiting disk 148 and plate 150 (FIG. 16); and in the third, fourth, and fifth embodiments, the primer or cocking system P3 (FIGS. 18 and 22), P3' (FIGS. 23 and 24) and P3" (FIG. 29) comprises a cam and cam follower wherein the cam follower is operatively connected to the hammer. The hammer 78 could be reciprocated (primed) by other means as well. For example, the hammer could be reciprocated using hydraulic or pneumatic cylinders. Alternatively, the hammer could be reciprocated by means of a solenoid.

As various changes could be made in the above constructions without departing from the scope of the claimed invention, it is intended that all matter contained in the above description or shown in the accompanying drawings shall be interpreted as illustrative and not in a limiting sense. For example, although the bracket legs 30,32 are designed as upper and lower legs, they could alternatively be designed as left and right side legs. This would alter the configuration of the inner edge of the legs. However, in this instance, the two legs would likely be substantially identical to each other. In either situation, the bracket plate 26 will be generally vertical when the bracket is mounted to the outlet hopper 12 and collar 14, and the vibrational energy from the impacts will be generally radially directed into the outlet hopper. The motor 38 could be arranged such that it is normal or perpendicular to the direction of impact. In this variation, the cam surface would be defined by a side surface, rather than an end surface, of the cam. The bracket 22 could be formed, such that the hammer 78 directly hits or impacts that collar 14. In this instance, the hammer 78 would preferably have a front face that conforms to the contours of the collar, such that the front face would be in contact with the collar over substantially the complete surface of the front face when the hammer hits the collar. These examples are merely illustrative.

The invention claimed is:

1. An impactor externally securable to a funnel-shaped outlet of a container of flowable material to break up voids in the material in the funnel-shaped outlet of the container or to break up bridging or clumping of the material in the funnel-shaped outlet of the container; the impactor comprising:

a strike plate fixedly mountable to an exterior surface of the container;

a drive operatively mounted to the strike plate which axially reciprocally moves a hammer, such that operation of the drive causes the hammer to impact the strike plate to thereby transmit vibrations to the exterior surface of the container, the drive comprising a primer operatively connected to the hammer to move the hammer from a first position in which said hammer is in contact with said strike plate to a second position in which said hammer is spaced from said strike plate, and a spring which is in operative contact with said hammer to propel the hammer from the second position to the first position so as to impact the strike plate; and a bracket configured to be fitted to the exterior surface of said container with at least one mounting strap so as to transmit said vibrations to the container, the bracket having a plate, a pair of horizontal wings extending obliquely from the sides of the plate, and an upper and a lower leg extending from the top and bottom of the plate, respectively, the at least one mounting strap connected to the wings of the bracket, the legs being sized and shaped such that the bracket plate is generally vertically oriented when mounted to a container and such that an inner edge of each leg generally engages the container along the full length of the inner edges of the legs, wherein the lower leg is planar and perpendicular to the plate, and the upper leg has a first section that is perpendicular to the plate and a second section that extends diagonally upwardly from an end of the first section to engage the funnel-shaped outlet of the container.

2. The impactor of claim 1 wherein said primer comprises a rotationally driven member; said member having a surface which is operatively connected to said hammer such that rotation of said member results in said hammer moving from said first position to said second position against the bias of said spring.

3. The impactor of claim 2 wherein said rotationally driven member is a cam and said surface is a cam surface; said hammer surrounding said rotationally driven cam; said impactor comprising a cam follower surface internally of said hammer.

4. The impactor of claim 3 including an axially movable cam; said axially movable cam defining said cam follower surface; said hammer being axially and rotationally fixed to said axially movable cam.

5. The impactor of claim 2 including a motor which operatively connected to said driven member to rotationally drive said rotationally driven member.

6. The impactor of claim 5 wherein said member is a cam and said surface is a cam surface; said cam surface being formed on an end face of said cam; and wherein said motor has an output shaft axially aligned with an axis of said cam.

7. The impactor of claim 6 including a driven shaft to which said rotationally driven cam is rotationally fixed, and a coupler for rotationally connecting said output shaft to said driven shaft.

8. The impactor of claim 1 including a guide sleeve which surrounds said hammer and extends at least a length equal to a length of travel of said hammer; said guide sleeve preventing said hammer from rotating.

9. The impactor of claim 8 wherein said guide sleeve has an inner surface and said hammer has an outer surface; said guide sleeve inner surface and said hammer outer surface being complementarily shaped relative to each other, said surfaces being non-circular.

10. The impactor of claim 9 wherein said guide sleeve inner surface and said hammer outer surface are both polygonal.

11. The impactor of claim 1 wherein said primer includes a disk which is driven in an orbital path and a plate having an L-shaped slot; one of the disk and the L-shaped slot defining a circumferential groove which receives the other of the disk and the L-shaped slot; whereby, as the disk is moved through its orbital path, the disk will translate the plate rearwardly; the plate being operatively connected to the hammer, such that as the plate moves rearwardly, the hammer is moved rearwardly to its said second position.

12. The impactor of claim 1 wherein said primer includes a rotationally driven cam and a cam follower; the cam follower being operatively connected to the hammer; the cam having a side edge defining a cam surface; the cam follower engaging the cam surface to be moved as the cam is rotated; whereby, the movement of the cam follower moves the hammer from its first position to its second position.

13. The impactor of claim 12 including a disk rotationally mounted in the drive housing; the cam follower being mounted to the disk offset from an axis of rotation of the disk, such that, as the cam is rotated, the disk will rotate; the impactor further including a flexible connecting member connected at one end to an edge of said disk, and operably connected at an opposite end to the hammer.

14. The impactor of claim 13 wherein said disk is a sprocket and said flexible connecting member is a chain.

15. The impactor of claim 12 including a driven shaft operatively connected at one end to said hammer, said driven shaft extending over said cam; said cam follower being mounted to said driven shaft, such that as said cam is rotated, said driven shaft will be moved laterally to move said hammer from its first position to its second position.

16. The impactor of claim 15 including anti-rotation means for preventing said driven shaft from rotating about an axis of said driven shaft.

17. The impactor of claim 16 wherein said anti-rotation means includes one or more of said driven shaft, a guide shaft extending generally parallel to said driven shaft and to which said driven shaft is operatively connected, and a wheel connected to said driven shaft and which rides on said cam.

18. The impactor of claim 12 wherein the cam follower comprises a plate operatively connected at one end to said hammer; said plate defining an opening surrounding said cam; said plate opening being in operative engagement with said cam surface.

19. The impactor of claim 18 wherein including a roller mounted to said plate in said plate opening, said roller engaging said cam surface.

* * * * *